US009878892B2

(12) United States Patent
Jersey et al.

(10) Patent No.: US 9,878,892 B2
(45) Date of Patent: Jan. 30, 2018

(54) VERTICAL BEVERAGE DISPENSING MANIFOLDS, DISPENSERS INCLUDING THE SAME, AND METHODS OF DISPENSING A BEVERAGE

(71) Applicant: PepsiCo, Inc., Purchase, NY (US)

(72) Inventors: Steven T. Jersey, Laguna Niguel, CA (US); Steven Headen, Newtown, CT (US); Brian C. Jones, New Hartford, CT (US); Chris Fernald, Plantsville, CT (US); Olga Sellmann, Cortlandt Manor, NY (US)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 15/016,466

(22) Filed: Feb. 5, 2016

(65) Prior Publication Data

US 2017/0225936 A1 Aug. 10, 2017

(51) Int. Cl.
*B67D 1/00* (2006.01)
*F25C 5/00* (2006.01)

(52) U.S. Cl.
CPC ..... *B67D 1/0041* (2013.01); *B67D 1/0021* (2013.01); *B67D 1/0044* (2013.01); *F25C 5/002* (2013.01)

(58) Field of Classification Search
CPC .. B67D 1/0041; B67D 1/0044; B67D 1/0021; F25C 5/002
USPC ..... 222/145.1, 145.5, 129.1, 145.6, 129.2
See application file for complete search history.

(56) References Cited

U.S. PATENT DOCUMENTS

| | | | | |
|---|---|---|---|---|
| 5,190,188 | A | 3/1993 | Credle, Jr. | |
| 6,223,948 | B1 * | 5/2001 | Davis | B67D 1/0021 222/129.1 |
| 7,575,185 | B2 | 8/2009 | Hammonds et al. | |
| 8,356,730 | B2 | 1/2013 | Bethuy et al. | |
| 8,490,829 | B2 | 7/2013 | Deo et al. | |
| 8,515,574 | B2 | 8/2013 | Studor et al. | |
| 8,768,524 | B2 | 7/2014 | Hammonds et al. | |
| 8,798,799 | B2 | 8/2014 | Deo et al. | |
| 8,910,674 | B2 | 12/2014 | Segiet et al. | |

(Continued)

FOREIGN PATENT DOCUMENTS

WO WO 2014/160346 A1 10/2014

OTHER PUBLICATIONS

International Search Report issued in International Appl. No. PCT/US2014/026357, dated Jul. 21, 2014, 2 pages.

(Continued)

*Primary Examiner* — Donnell Long
(74) *Attorney, Agent, or Firm* — Sterne, Kessler, Goldstein & Fox P.L.L.C.

(57) ABSTRACT

Vertical beverage dispensers including a vertical dispensing manifold for dispensing a beverage. The vertical dispensing manifold may include an input port coupled to one end of a vertical shaft and a dispensing nozzle coupled to the other end of the vertical shaft. The vertical shaft may include a hollow interior and a plurality of orifices for introducing ingredients into the hollow interior formed in the sidewall of the vertical shaft. The vertical shaft may define a vertical flow path for the flow of a base liquid from the input port, through the vertical shaft to combine with one or more ingredients, and to the dispensing nozzle. The flow of base liquid and ingredients within the vertical shaft may be uniform.

20 Claims, 15 Drawing Sheets

(56) References Cited

U.S. PATENT DOCUMENTS

| | | | | |
|---|---|---|---|---|
| 2005/0067433 | A1* | 3/2005 | Brandt | B67D 1/0043 222/145.5 |
| 2006/0144075 | A1 | 7/2006 | Bowen et al. | |
| 2007/0205220 | A1 | 9/2007 | Rudick et al. | |
| 2009/0230149 | A1 | 9/2009 | Smeller et al. | |
| 2010/0102087 | A1 | 4/2010 | Meike et al. | |
| 2010/0145522 | A1 | 6/2010 | Claesson et al. | |
| 2011/0068118 | A1* | 3/2011 | Jones | A47J 31/402 222/1 |
| 2012/0055954 | A1 | 3/2012 | Hecht | |
| 2013/0147092 | A1 | 6/2013 | Jenko et al. | |
| 2015/0020691 | A1 | 1/2015 | Midden et al. | |
| 2016/0009539 | A1 | 1/2016 | Jersey et al. | |

OTHER PUBLICATIONS

Notification of Transmittal of the International Search Report and the Written Opinion of the International Searching Authority, or the Declaration issued in International Application No. PCT/US2017/016223, dated Apr. 27, 2017.

* cited by examiner

VERTICAL BEVERAGE DISPENSING MANIFOLDS, DISPENSERS INCLUDING THE SAME, AND METHODS OF DISPENSING A BEVERAGE

FIELD

The described embodiments generally relate to beverage dispensing. In particular, embodiments relate to vertical dispensing manifolds for dispensing a beverage and methods related to the same.

BACKGROUND

Beverage dispensers are used to dispense beverages to customers at various locations, such as restaurants, cafeterias, theatres and other entertainment and/or food service venues. Some beverage dispensers include a dispensing head in communication with a particular drink syrup supply source via a single pipe dedicated to supply the particular drink syrup to that dispensing head. These beverage dispensers may include a dedicated dispensing head for each particular beverage.

Some beverage dispensers may have a relatively limited number of beverages that may be dispensed (e.g., equal to the number of dispensing heads on the beverage dispenser). For example, beverages typically available at some beverage dispensers are a regular cola beverage, a diet cola beverage, perhaps one or several non-cola carbonated beverages, such as a lemon-lime flavored carbonated beverage or some other fruit-flavored beverage (e.g., orange flavored carbonated beverage, and/or root beer), and perhaps one more non-carbonated beverage(s), such as a tea and/or a lemonade.

A larger number of available beverage choices, and the ability to customize beverages for consumers, may be desirable for a venue owner and/or operator. Positive user experience and user satisfaction associated with the use of a beverage dispenser may be desirable tool for a venue owner/operator to entice beverage sales and return customers. Moreover, positive user experience and user satisfaction may facilitate brand recognition for the manufacturer and/or distributor of a beverage dispenser and may be a valuable marketing tool.

Therefore, a continuing need exists for innovations in dispensers configured to dispense various beverage types, and dispensers configured to allow customization of beverages by consumers.

BRIEF SUMMARY OF THE INVENTION

Some embodiments are directed to a vertical dispensing manifold for dispensing a beverage, the vertical dispensing manifold including an input port for receiving a base liquid, a vertical shaft coupled to the input port, the vertical shaft including a hollow interior defined by a sidewall of the vertical shaft and a plurality of orifices for introducing ingredients into the hollow interior, where each orifice is formed in the sidewall of the vertical shaft and is in communication with the hollow interior of the vertical shaft, and a dispensing nozzle coupled to the vertical shaft for dispensing a combination of the base liquid and one or more ingredients, where the hollow interior of the vertical shaft defines a vertical flow path for the flow of the base liquid from the input port, through the vertical shaft to combine with one or more ingredients, and to the dispensing nozzle.

In some embodiments, the vertical shaft may include a plurality of modules releasably coupled together between the input port and the dispensing nozzle, and each module may include one or more orifices for introducing ingredients into the hollow interior of the vertical shaft, where each orifice is formed in a sidewall of the modules and is in communication with the hollow interior of the vertical shaft. In some embodiments, each module may include a first coupling disposed on an upper end the module and a second coupling disposed on a lower end of the module. In some embodiments, an uppermost module is releasably coupled to the input port and a lowermost module is releasably coupled to the dispensing nozzle. In some embodiments, the vertical flow path of the modules allows the base liquid to flow vertically between the input port and the dispensing nozzle, and the vertical flow may include uniform flow.

In some embodiments, the orifices in the vertical shaft may be oriented in a direction substantially perpendicular to a central vertical axis of the vertical shaft. In some embodiments, the vertical shaft may include orifices located on opposing sides of the vertical shaft.

In some embodiments, the vertical shaft may be a single integrally formed piece. In some embodiments, the modules may be single integrally formed pieces.

In some embodiments, the orifices in the vertical shaft are arranged vertically in a staggered configuration on the sidewall of the vertical shaft.

In some embodiments, the input port may be coupled to an upper end of the vertical shaft and the dispensing nozzle is coupled to a lower end of the vertical shaft.

In some embodiments, the vertical dispensing manifold may include an ingredient delivery fitting coupled to an orifice and at least partially disposed in the orifice.

In some embodiments, the vertical shaft may include an orifice having a first exterior diameter disposed vertically above an orifice having a second exterior diameter and the first diameter may be smaller than the second diameter. In some embodiments, the vertical shaft may include a plurality of orifices having a first exterior diameter and a plurality of orifices having a second exterior diameter larger than the first diameter and all the orifices having the first diameter may be disposed above all the orifices having the second diameter.

In some embodiments, the vertical shaft may include a length measured between the input port and the dispensing nozzle and the length of the vertical shaft may be larger than the interior diameter of the vertical shaft.

Some embodiments are directed towards a dispenser for dispensing a beverage, the dispenser including a vertical dispensing manifold including a vertical shaft having a hollow interior defined by a sidewall and a plurality of orifices formed in the sidewall for introducing ingredients into the hollow interior, an input port for receiving a base liquid coupled to an upper end of the vertical shaft, and a dispensing nozzle coupled to a lower end of the vertical shaft for dispensing a combination of the base liquid and one or more ingredients. The dispenser may also include a base liquid delivery tube in fluid communication with the input port and a plurality of ingredient tubes coupled to respective orifices by ingredient delivery fittings at least partially disposed within the orifices.

In some embodiments, the dispenser may include an ice chute. In some embodiments, the ice chute may include a channel with a supply end coupled to an ice reservoir and a dispensing end surrounding at least a portion of the dispensing nozzle.

In some embodiments, the ingredient delivery fittings are releasably disposed in the orifices in the vertical shaft.

Some embodiments are directed towards a modular dispensing manifold for dispensing a beverage, the modular dispensing manifold including a first manifold module having a hollow interior defined by a sidewall of the first manifold module and a plurality of orifices formed in the sidewall of the first manifold module for introducing ingredients into the hollow interior, a first coupling disposed at an upper end of the first manifold module, and a second coupling disposed at a lower end of the first manifold module; a second manifold module having a hollow interior defined by a sidewall of the second manifold module and a plurality of orifices formed in the sidewall of the second manifold module for introducing ingredients into the hollow interior, a third coupling disposed at an upper end of the second manifold module, and a fourth coupling disposed at a lower end of the second manifold module; an input port coupled to the first coupling of the first manifold module, the input port configured to receive a base liquid; a dispensing nozzle coupled to the fourth coupling of the second manifold module, the dispensing nozzle configured to dispense a beverage, where the second coupling of the first manifold module is coupled to the third coupling of the second manifold module, and where the hollow interiors of the first and second manifold modules define a vertical flow path for the flow of the base liquid from the input port, through the vertical shaft, and to the dispensing nozzle.

BRIEF DESCRIPTION OF THE DRAWINGS/FIGURES

DETAILED DESCRIPTION OF THE INVENTION

Figure 1:
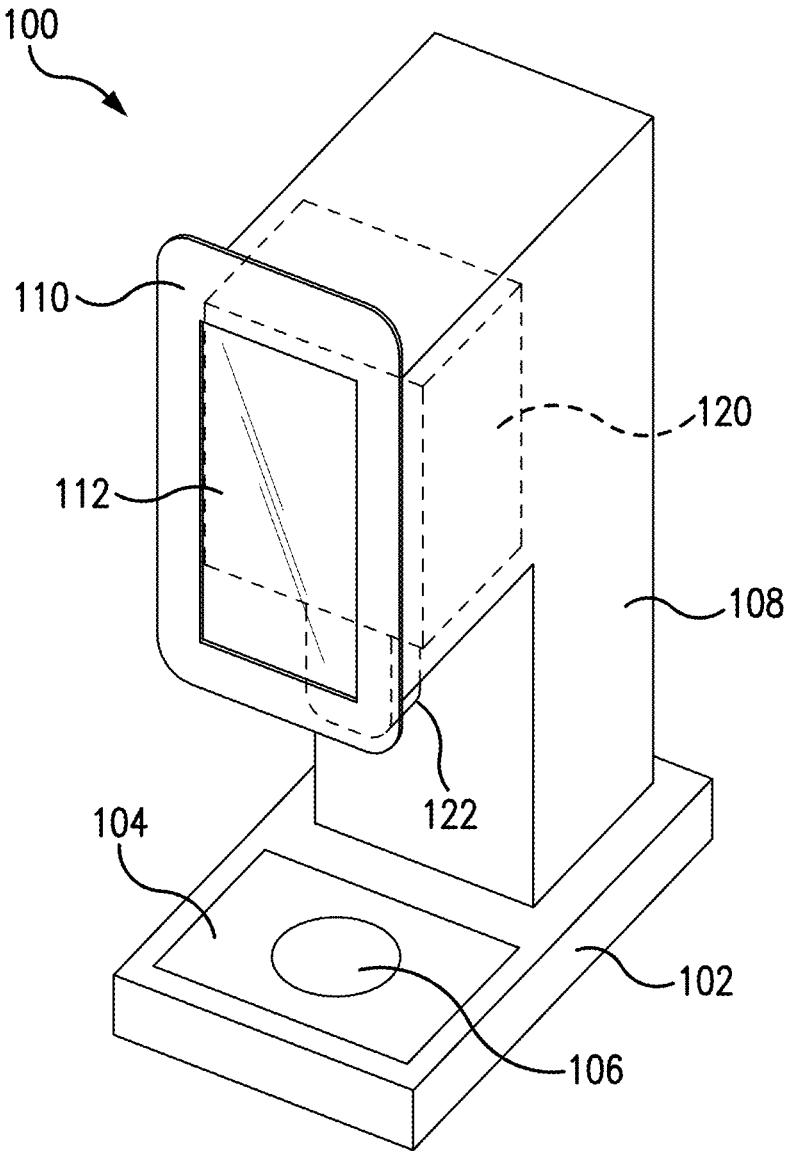
FIG. 1 is a front perspective view of a beverage dispenser according to an embodiment.

The present invention(s) will now be described in detail with reference to embodiments thereof as illustrated in the accompanying drawings. References to "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

A consumer may choose to purchase a beverage directly dispensed from a beverage dispenser into his or her cup (e.g., a fountain drink) for a variety of reasons. In contrast to purchasing a packaged (e.g., bottled or canned) beverage, purchasing a fountain drink may provide the consumer with increased control over the amount of a beverage(s) and type(s) of beverage he or she may receive. For example, purchasing a fountain drink allows a consumer to choose from a variety of different beverage types, allows a customer to try various types of beverages, and allows a customer to re-fill his or her cup with a desired about of the same beverage, or a different beverage. Moreover, purchasing a fountain drink may give a customer the freedom to customize his or her drink by mixing different beverage types (e.g., a consumer may mix a regular cola with a diet cola).

In some instances, a dispenser may allow a consumer to customize his or her beverage by pre-selecting a combination of beverages, flavors, additives, etc. that are dispensed into his or her cup. In such cases, the beverage dispenser may include a user interface that allows a consumer to make desired selections. This flexibility and customization may entice beverage sales and attract consumers to locations that provide dispensers with such capabilities. The customization of beverages may be enjoyable for consumers and may positively contribute to the consumers' experience and satisfaction at a particular venue (e.g., a restaurant, a cafeteria, a theatre, and other entertainment and/or food service venues). As such, these attributes of a dispenser may be desirable for an owner and/or operator of a venue (hereinafter referred to as an "entrepreneur") trying to attract consumers and entice return customers.

In addition to consumer appeal and satisfaction, the assembly of a beverage dispenser may be a consideration for an entrepreneur. An entrepreneur may desire a beverage dispenser that is easy to assemble and disassemble (e.g., repair), that is easy to perform routine maintenance on (e.g., easy to clean), and is easy to operate by the entrepreneur's employees. Such a beverage dispenser may reduce the time and cost associated with use and/or maintenance of a beverage dispenser. Time and cost associated with the use and/or maintenance of a beverage dispenser may influence an entrepreneur's decision of which brand of beverage dispenser to purchase.

Moreover, an entrepreneur may desire a dispenser that is easily upgraded and/or retrofitted with new components. Upgrades and/or retrofits may provide improved or enhanced experiences for customers of the entrepreneur's venue. For example, upgrades and/or retrofits may improve an interactive display on the dispenser or improve the dispensing capabilities of a dispenser (e.g., by increasing the number of beverage types that may be dispensed or by improving the mixing capabilities of a dispenser).

In some instances an entrepreneur may desire a beverage dispenser having a compact design. A compact design may reduce the amount of floor or counter space needed to accommodate the dispenser. Freeing up floor and/or counter space may allow the entrepreneur to provide additional accommodations for customers (e.g., an additional table for seating customers, or an additional beverage dispenser for serving additional customers). In some instances, freeing up additional space may provide a more spacious and inviting venue for customers.

Additionally, a manufacturer or distributor of a beverage dispenser may desire a beverage dispenser that is easy to assemble and disassemble (e.g. repair), that is easy to perform routine maintenance on, and that is easy to operate by the manufacture/distributor's employees. Such a dispenser may reduce the time and cost associated with upkeep of the dispensers the manufacturer/distributor sells. A manufacturer or distributor may also desire a beverage dispenser that is easily upgraded and/or retrofit with new components. Upgrades and/or retrofits may be used to improve or enhance a consumer's interaction with a beverage dispenser. Improving or enhancing a consumer's interaction with a beverage dispenser may create positive brand recognition for the manufacturer/distributor and may be an important marketing tool.

In some embodiments, dispensers discussed herein may include a modular dispensing manifold with components that are easily assembled and/or disassembled. In some embodiments, the modular dispensing manifold may include components releasably coupled together via releasable couplings. Modular components that are easily assembled and/or disassembled my reduce time and cost associated with maintenance and/or repair of a beverage dispenser. Additionally, easily assembled/disassembled components may make upgrading and/or retrofitting a beverage dispenser less time consuming and costly. In some embodiments, the modularity of a beverage dispenser may allow an entrepreneur to order additional modules for increasing the number of beverage choices available at a dispenser. For example, an additional module may be incorporated into a dispensing manifold to increase the number of ingredients that may be mixed with a base liquid, which in turn increases the number of available beverage choices for selection by a consumer.

In some embodiments, beverage dispensers discussed herein may include a vertical dispensing manifold configured to facilitate a flow of base liquid through the dispensing manifold having a substantially uniform velocity across an open channel (hollow interior) of the dispensing manifold (i.e., uniform cross-sectional flow). The vertical dispensing manifold may be configured to introduce one or more ingredients into the uniform flow of the base liquid to create a mixed beverage. The uniform and vertical flow of beverages within the dispensing manifold may reduce carry-over between different "beverage doses" (e.g., different consumer's beverage choices) from a single dispensing manifold. In some embodiments, the uniform and vertical flow of beverages may facilitate even and consistent mixing of a base liquid and one or more ingredients. Even and consistent mixing of a base liquid and ingredients may prevent dispensing a non-homogenous beverage this is not fully mixed (e.g., a dispensing a beverage with streaks of different colors). Dispensing a non-homogenous beverage may be less aesthetically appealing for customers than when a homogenous beverage is dispensed.

As used herein the term "uniform flow" or "uniform cross-sectional flow" means the flow of a liquid which has substantially the same velocity measured across the hollow interior of the shaft through which the liquid is flowing in a direction perpendicular to the directional flow of the liquid. The velocity of the liquid may increase as it moves through the hollow interior of the shaft (e.g., from the top to the bottom of a shaft), but at points along the shaft, the velocity of the liquid across the shaft measured in a direction perpendicular the flow of the liquid is substantially the same. When measuring a "uniform flow" or "uniform cross-sectional flow" the velocity of the liquid in the thin boundary layer of liquid located adjacent to the sidewall(s) of the hollow interior of the shaft is excluded. In some embodiments, the uniform flow of a liquid may be a turbulent flow.

In some embodiments, a vertical dispensing manifold may include a compact configuration that allows a large variety of beverages to be produced (e.g., mixed) and dispensed in a relatively small footprint. The vertical dispensing manifold may include orifices for introducing ingredients into a base liquid flowing through a vertical dispensing manifold. The orifices may be oriented in a substantially horizontal direction to facilitate assembly and disassembly of ingredient delivery fittings that supply ingredients to vertical dispensing manifold. The horizontal orientation of the orifices and ingredient delivery fittings may minimize the tubing bundle pathway volume while maintaining an organized interior of a beverage dispenser.

The embodiments discussed herein may be used to form a wide variety of beverages, including but not limited to cold and hot beverages, and including but not limited to beverages known under any PepsiCo branded name, such as Pepsi-Cola®.

FIG. 1 shows a dispenser 100 according to an embodiment. Dispenser 100 may include a base 102 coupled to a body 108. Base 102 may serve to support body 108 in an upright position. Base 102 may include a drip tray 104 with a dispense location 106 located within the area occupied by drip tray 104. A user (e.g., a customer) may place his or her cup at dispense location 106 to receive his or her desired beverage and/or to receive ice. Body 108 may include a user interface 110 for receiving commands from a user. User interface 110 may include a display screen 112 configured to display information for a user and/or receive commands from a user. Display screen 112 may be a touch screen, such as but not limited to, a liquid crystal display (LCD) touchscreen or a light emitting diode (LED) touchscreen.

Body 108 may house a dispensing manifold 120 including a dispensing nozzle 122 for dispensing a beverage at dispense location 106. Dispensing manifold 120 may be a vertical dispensing manifold as discussed herein. In some embodiments, dispenser 100 may be configured to sit on a counter-top at a venue. In some embodiments, dispenser 100 may be a standalone disperser having its own support structure for elevating it above floor level at a venue.

In some embodiments dispenser 100 may be configured to dispense a free flowing food product. The free flowing food product (e.g., a beverage) may be dispensed when a container or cup is placed underneath a dispensing nozzle of dispenser 100, such as on drip tray 104 at dispense location 106. A user may initiate the dispensing of the beverage, e.g., by interacting with a user interface, such as display screen 112, to make a selection of his or her desired beverage to be dispensed by dispenser 100. In some embodiments, ice for the beverage may be dispensed by the dispenser 100. Dispenser 100 may be a self-serve station, or may be used at a crew or server station, where a user is a server who will be delivering the beverage to a counter, delivery area, or customer.

Figure 2:
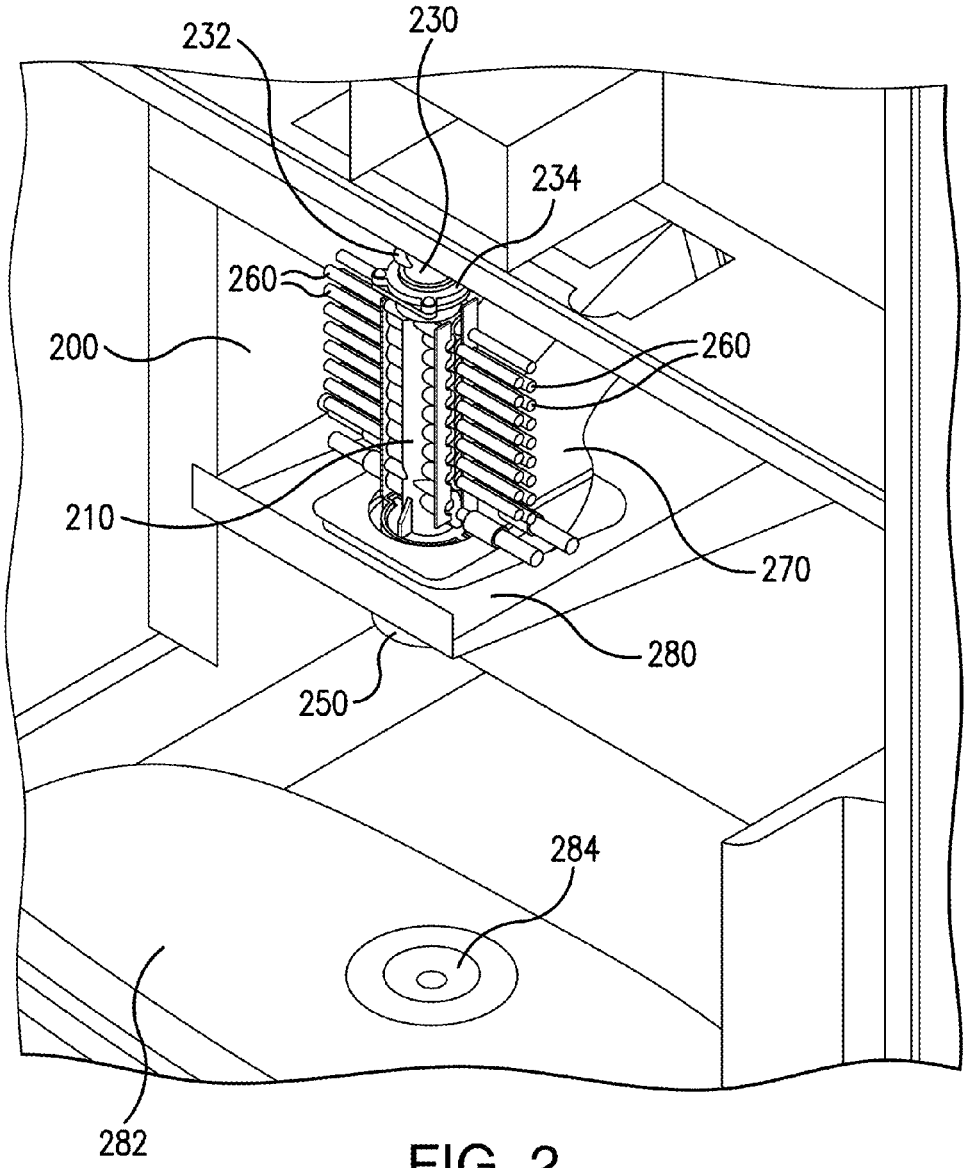
FIG. 2 is a partial interior view of a beverage dispenser according to an embodiment.
Figure 3:
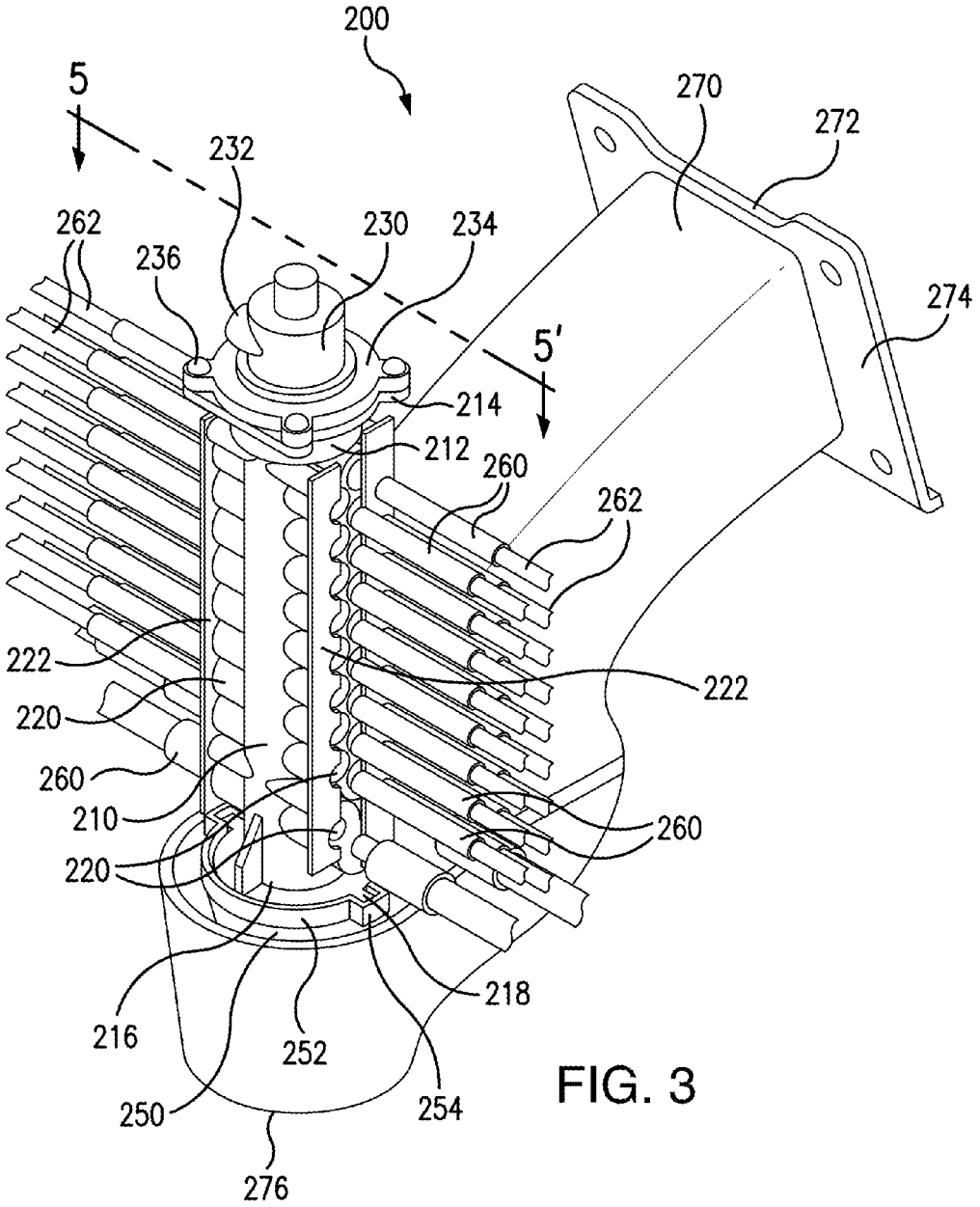
FIG. 3 is a perspective view of a beverage dispensing manifold according to an embodiment.

FIGS. 2 and 3 show a vertical dispensing manifold 200 for a dispenser according to an embodiment. Vertical dispensing manifold 200 may include an input port 230 for receiving a base liquid (e.g., a water). As used herein "base liquid" includes, but is not limited to, carbonated water, non-carbonated water, or a mixture thereof. In some embodiments, the base liquid may be cooled, so as to create a cold beverage, or heated, so as to create a hot beverage. Input port 230 may include one or more connectors 232 for connecting to a base liquid delivery tube that supplies a base liquid to input port 230.

Input port 230 may be coupled to a vertical shaft 210 of dispensing manifold 200. In some embodiments, input port 230 may be coupled to an upper end 212 of vertical shaft 210 via a coupling 234 of input port 230. Coupling 234 may be a releasable coupling including one or more fasteners 236. Coupling 234 and fasteners 236 may be configured to releasably attach to an upper coupling 214 of vertical shaft 210. The releasable attachment between coupling 234/fasteners 236 and upper coupling 214 may include, but is not limited to, a threaded attachment, a blot and nut attachment, a luer-lock attachment, a snap-fit attachment, or a combination thereof. In some embodiments, the attachment between coupling 234 and upper coupling 214 may be a non-releasable attachment, e.g., a weld such as an ultrasonic weld. In some embodiments, the attachment between coupling 234 and upper coupling 214 may be watertight. In such embodiments, coupling 234 and/or upper coupling 214 may include a seal or gasket, such as an O-ring.

A dispensing nozzle 250 may be coupled to vertical shaft 210 for dispensing a beverage (e.g., a combination of a base liquid and one or more ingredients) from dispensing manifold 200. In some embodiments, dispensing nozzle 250 may be coupled to a lower end 216 of vertical shaft 210 via a coupling 252 on dispensing nozzle 250. Coupling 252 may be a releasable coupling including one or more fasteners 254. Coupling 252 and fasteners 254 may be configured to releasably attach to a lower coupling 218 of vertical shaft 210. The releasable attachment between coupling 252/fasteners 254 and lower coupling 218 may include, but is not limited to, a threaded attachment, a blot and nut attachment, a luer-lock attachment, a snap-fit attachment, or a combination thereof. In some embodiments, the attachment between coupling 252 and lower coupling 218 may be a non-releasable attachment, e.g., a weld such as an ultrasonic weld. In some embodiments, the attachment between coupling 252 and lower coupling 218 may be watertight. In such embodiments, coupling 252 and/or lower coupling 218 may include a seal or gasket, such as an O-ring.

Vertical shaft 210 may be the same or similar to vertical shafts 400 and 600 discussed herein. Vertical shaft 210 may include a hollow interior (see e.g., 432 in FIG. 4) and a plurality of orifices 220 for introducing one or more ingredients into the hollow interior. Each orifice 220 may be in direct communication with the hollow interior of vertical shaft 210. Each orifice 220 may be configured to couple with (e.g., receive) an ingredient delivery fitting 260. In some embodiments, ingredient delivery fittings 260 may be releasably coupled to orifices 220. Ingredient delivery fittings 260 may be the same as or similar to ingredient delivery fittings 1000 and 1100 discussed herein. Ingredient tubes 262 may be connected to ingredient delivery fittings 260 for supplying ingredients to ingredient delivery fittings 260.

In some embodiments, vertical shaft 210 may include one or more stop walls 222 configured to hold and/or position ingredient delivery fittings 260 relative to orifices 220 (e.g., within orifices 220). Stop walls 222 may be releasably coupled to vertical shaft 210 (e.g., via mechanical fasteners such as screws). The releasable coupling of stop walls 222 to vertical shaft 210 may allow stop walls 222 to be removed so that ingredient delivery fittings 260 may be replaced or added. In some embodiments, stop walls 222 may include a releasable fastener, such as a snap-fit fastener for holding and/or positioning ingredient delivery fittings 260 within orifices 220. In such embodiments, the releasable attachment mechanisms may engage a portion of an ingredient delivery fitting 260 when an ingredient delivery fitting 260 is properly positioned within an orifice 220.

The hollow interior of vertical shaft 210 may define a vertical flow path for the flow of a base liquid from input port 230, through vertical shaft 210 to combine with one or more ingredients, and to dispensing nozzle 250. In some embodiments, dispensing manifold 200 may be configured to facilitate a uniform flow of a base liquid and/or one or more ingredients through dispensing manifold 200 on the vertical flow path in a vertical direction from input port 230, through vertical shaft 210, and to dispensing nozzle 250. Uniform flow through vertical shaft 210 may provide constant streamlines of the liquids and may facilitate homogenous mixing of a base liquid with one or more ingredients. Additionally, uniform flow through vertical shaft 210 may minimize carbonation breakout, the release of $CO_2$, which occurs when a carbonated beverage is dispensed from dispensing nozzle 250. In some embodiments, the flow along vertical flow path may be gravity-assisted.

In some embodiments, dispensing manifold 200 may include an ice chute 270. Ice chute 270 includes a supply end 272 for receiving ice from an ice source (e.g., an ice reservoir) and a dispensing end 276 for dispensing ice. Supply end 272 may include a coupling 274 configured to couple to an ice reservoir. In some embodiments, coupling 274 may be a releasable coupling. In some embodiments, dispensing nozzle 250 and dispensing end 276 of ice chute 270 may be configured to dispense a beverage and ice at a single dispense location (e.g., a dispense location 284 on a drip tray 282 as shown in FIG. 2). Dispensing at a single dispense location may allow a beverage and ice to be dispensed into a user's cup simultaneously. In some embodiments, ice chute 270 may be the same as or similar to ice chute 840 discussed herein. In some embodiments, dispensing manifold 200, or portions thereof, may be supported within a dispenser by a support plate 280.

Figure 4:
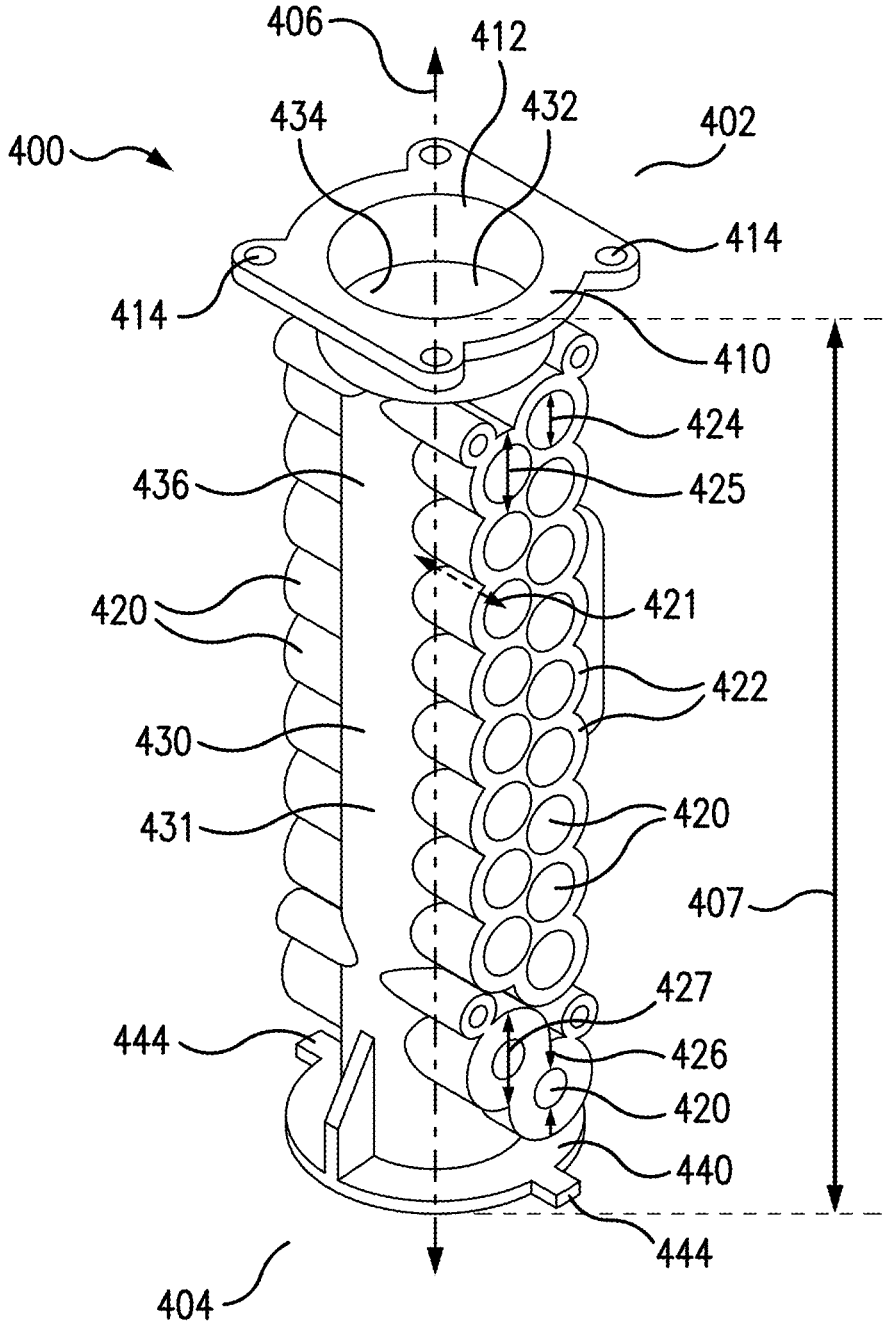
FIG. 4 is a perspective view of a dispensing manifold having a vertical shaft according to an embodiment.

FIG. 4 shows a vertical shaft 400 according to an embodiment. Vertical shaft 400 includes an upper end 402 disposed opposite a lower end 404 in a vertical direction (e.g., in the direction of vertical axis 406 of vertical shaft 400). Vertical axis 406 may be a central vertical axis of vertical shaft 400 extending through the geometrical center of vertical shaft 400 in the vertical direction. In some embodiments, vertical axis 406 may be the vertical axis of rotation for vertical shaft 400.

Upper end 402 of vertical shaft 400 may include an upper coupling 410 the same as or similar to upper coupling 214. In some embodiments, upper coupling 410 may include holes 414 for receiving fasteners (e.g., fastener 236). In some embodiments, upper coupling 410 may define an upper opening 412 of vertical shaft 400. Lower end 404 of vertical shaft 400 may include a lower coupling 440 the same as or similar to lower coupling 218. In some embodiments, lower coupling 440 may include fasteners 444 (e.g., projections) configured to releasably attach to attachment features (e.g., grooves) formed in a coupling of a dispensing nozzle (e.g., lower coupling 440 and coupling 252 of dispensing nozzle 250 may be attached via a luer-lock connection). In some embodiments, lower coupling 440 may define a lower opening 442 of vertical shaft 400. In some embodiments, lower coupling 440 and upper coupling 410 may be the same.

Figure 5:
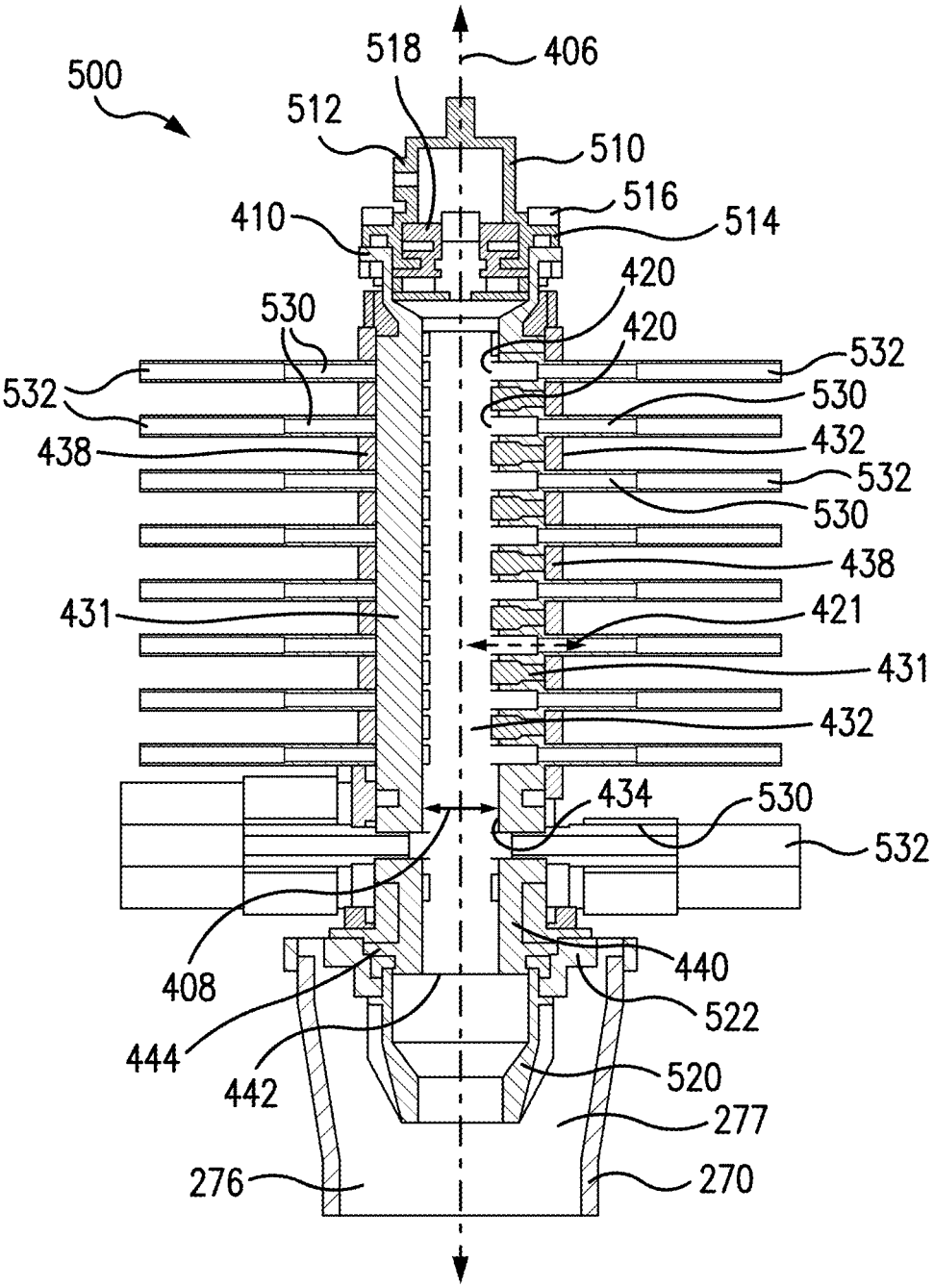
FIG. 5 is a cross-sectional view of a beverage dispensing manifold according to an embodiment taken along the line 5-5' in FIG. 3.

FIG. 5 shows cross-sectional view of a dispensing manifold 500 according to an embodiment with a vertical shaft 400 along the cross-sectional line 5-5' in FIG. 3. As shown in FIG. 5, an input port 510 may be coupled to upper end 402 of vertical shaft 400 via upper coupling 410. Input port 510 may include a coupling 514 and fasteners 516 for attaching to upper coupling 410. Input port 510 may be referred to as a water plenum or water chamber. In some embodiments, the attachment between coupling 514 and upper coupling 410 may be a releasable attachment such as but not limited to, a threaded attachment, a blot and nut attachment, a luer-lock attachment, a snap-fit attachment, or a combination thereof. In some embodiments, the attachment between coupling 514 and upper coupling 410 may be a non-releasable attachment, e.g., a weld such as an ultrasonic weld. In some embodiments, the attachment between coupling 514 and upper coupling 410 may be watertight. In such embodiments, coupling 514 and/or upper coupling 410 may include a seal or gasket, such as an O-ring.

Input port 510 may include one or more connectors 512 for connecting to a base liquid delivery tube that supplies a base liquid to input port 510. In some embodiments, input port 510 may include two connectors (e.g., like input port 710) for receiving base liquids. In some embodiments, input port 510 may include a diffuser 518. Diffuser 518 may facilitate uniform flow through vertical shaft 400 by introducing a base liquid into vertical shaft 400 with a uniform flow. In some embodiments, diffuser 518 may be a diffuser as discussed in PCT/US2014/026357, titled "Micro Dosing Dispensing System," filed Mar. 13, 2014, which is hereby incorporated herein by reference thereto. In some embodiments, diffuser 518 may be coupled to upper coupling 410. In some embodiments, diffuser 518 may be positioned within upper opening 412 of vertical shaft 400.

In some embodiments, diffuser 518 may include a sintered disc. The sintered disc may include small open through pores. As a base liquid is pushed through the sintered disc diffuser, the small pore size of the diffuser results in laminar flow inside the diffuser pore structure. Laminar flow within the diffuser occurs because the pores are smaller than the fluidic boundary layer. In the fluidic boundary layer, there is a high velocity gradient which defines the flow as laminar. In the laminar boundary layer, the flow can be characterized as gentile and orderly. A sintered disc diffuser imparts a high pressure drop through a gentile expansion process and thereby allows a base liquid to leave the diffuser and enter vertical shaft 400 at essentially atmospheric pressure. This gentile expansion process may reduce the breakout of dissolved carbon dioxide as compared to diffusers which rely on highly turbulent flow to create the required pressure drop. In some embodiments, the sintered disc may be a sintered metal disc.

As shown in FIG. 5, a dispensing nozzle 520 may be coupled to lower end 404 of vertical shaft 400 via lower coupling 440 and fasteners 444. Dispensing nozzle 520 may include a coupling 522 for attaching to lower coupling 440. In some embodiments, the attachment between coupling 522 and lower coupling 440 may be a releasable attachment such as but not limited to, a threaded attachment, a blot and nut attachment, a luer-lock attachment, a snap-fit attachment, or a combination thereof. In some embodiments, the attachment between coupling 522 and lower coupling 440 may be a non-releasable attachment, e.g., a weld such as an ultrasonic weld. In some embodiments, the attachment between coupling 522 and lower coupling 440 may be watertight. In such embodiments, coupling 522 and/or lower coupling 440 may include a seal or gasket, such as an O-ring.

Vertical shaft 400 may include a hollow interior 432 defined by upper coupling 410, lower coupling 440, and a sidewall 431 of a shaft 430 disposed between upper coupling 410 and lower coupling 440. Hollow interior 432 may define a vertical flow path through vertical shaft 400 from upper opening 412 to lower opening 442 (e.g., from input port 510 to dispensing nozzle 520). In some embodiments, vertical shaft 400 may have a length 407 measured between upper opening 412 and lower opening 442 in the range of 5.0 centimeters to 50 centimeters. In some embodiments, length 407 may be in the range of 5.0 centimeters to 40 centimeters. A length 407 significantly above 40 centimeters (e.g., greater than 50 centimeters) may result in a loss of uniform flow at lower end 404 of vertical shaft 400.

Base liquid entering vertical shaft 400 through input port 510 may flow through a hollow interior 432 of vertical shaft 400 along vertical axis 406. Hollow interior 432 may be defined by an interior surface 434 of sidewall 431. In some embodiments, hollow interior 432 may have a cylindrical shape with an interior diameter 408. Interior diameter 408 may be sized to facilitate uniform flow of fluids (e.g., a base liquid and one or more ingredients) through hollow interior 432. Interior diameter 408 may be tailored based on the dispensed volumetric flow rate of the base liquid flowing through vertical shaft 400. Interior diameter 408 may be in the range of 1.0 centimeters to 2.5 centimeters for a flow rate of 2.0 to 4.0 oz/second. Generally, the lower the flow rate, the smaller diameter 408 required to maintain uniform flow through vertical shaft 400. In some embodiments, interior diameter 408 may be constant along the length of hollow interior 432. In some embodiments, interior diameter 408 may vary along the length of hollow interior 432. Length 407 of vertical shaft 400 may be larger than interior diameter 408 of vertical shaft 400. In some embodiments, length 407 may be at least two or three times larger than interior diameter 408.

Vertical shaft 400 may include a plurality of orifices 420 for introducing ingredients into hollow interior 432. For example, orifices 420 may be configured to introduce one or more ingredients into the uniform flow of a base liquid flowing through hollow interior 432. Orifices 420 may be formed in sidewall 431 of vertical shaft 400 and may be in communication with hollow interior 432 of vertical shaft 400. In some embodiments, orifices 420 may be in direct communication with hollow interior 432 of vertical shaft 400. Each orifice 420 may be configured to couple with (e.g., receive) an ingredient delivery fitting (e.g., ingredient delivery fittings 1000 or 1100 discussed herein). Orifices 420 may include an orifice wall 422 extending from an external surface 436 of sidewall 431 of vertical shaft 400. Orifice walls 422 may define an interior diameter and an exterior diameter of orifices 420. In some embodiments, one or more orifices 420 may include a separate and distinct orifice wall 422. In some embodiments, one or more orifices 420 may share orifice walls 422 (e.g., orifice walls 422 may be integrally formed with each other).

As shown in FIG. 5, dispensing manifold 500 may include one or more ingredient delivery fittings 530 coupled to orifice(s) 420. In some embodiments, ingredient delivery fittings 530 may be releasably coupled to orifices 420. In some embodiments, ingredient delivery fittings 530 may be at least partially disposed in orifices 420. In some embodiments, ingredient delivery fittings 530 may extend through orifices 420 to interior surface 434 of the vertical shaft 400. In some embodiments, ingredient delivery fittings 530 do not extend past interior surface 434 into hollow interior 432 of vertical shaft 400 (i.e., the output ends of ingredient delivery fittings 530 do not extend into hollow interior 432). In some embodiments, the output ends of ingredient delivery fittings 530 may be flush with interior surface 434 of hollow interior 432. As used herein "flush" refers to two surfaces sharing the same geometric plane, at least at their edges. In some embodiments, flush surfaces may be flush within a deviation of +/−1/16 of an inch. Ingredient delivery fittings 530 that are flush with or do not extend into hollow interior 432 of vertical shaft 400 may facilitate uniform flow of a base liquid and ingredients through vertical shaft 400. In some embodiments, the output ends of ingredient delivery fittings 530 may extend slightly into hollow interior 432 (e.g., by approximately 1/8 of an inch). Slight extension of ingredient delivery fittings 530 into hollow interior 432 may not significantly affect uniform flow within hollow interior 432 and may facilitate rinsing of the output ends of ingredient delivery fittings 530.

Ingredient delivery fittings 530 may be the same as or similar to ingredient delivery fittings 1000 and 1100 discussed herein. Ingredient tubes 532 may be connected to ingredient delivery fittings 530 for supplying ingredients to ingredient delivery fittings 530, and therefore hollow interior 432 of vertical shaft 400. In some embodiments, vertical shaft 400 may include a stop wall 438 configured to hold and/or position the ingredient delivery fittings 530 relative to orifices 420 (e.g., within orifices 420). Stop wall 438 may be the same as or similar to stop wall 222.

When one or more ingredients are added to the uniform flow of a base liquids flowing through hollow interior 432, hollow interior 432 may act as a mixing chamber for mixing the base liquid with the ingredients. The uniform flow of the base liquid and the ingredients may facilitate homogenous mixing within hollow interior 432, which in turn results in a homogenously mixed beverage being dispensed from dispensing manifold. In some embodiments, vertical shaft 400 may include orifices having different sizes (e.g., orifices 420 having different sized interior and/or exterior diameters). For example, as shown in FIG. 4, vertical shaft 400 may include orifices 420 having a first interior diameter 424 and a first exterior diameter 425 and orifices 420 having a second interior diameter 426 and a second exterior diameter 427. Different interior and/or exterior diameters may allow for connection of different types of ingredient delivery fittings (e.g., for different types of ingredients). For example, a more viscous ingredient, such as liquid sugar, may require a differently sized ingredient delivery fitting than a less viscous ingredient (e.g., a flavoring) The ingredient delivery fitting for a more viscous liquid may be configured to couple with an orifice having a larger exterior diameter and/or smaller interior diameter to account for the larger amount of pressure required to dispense the more viscous liquid from the ingredient delivery fitting.

In some embodiments, vertical shaft 400 may include an orifice 420 having a smaller first exterior diameter 425 disposed vertically above an orifice 420 having a larger second exterior diameter 427. In some embodiments, all the orifices 420 on vertical shaft 400 having a smaller first exterior diameter 425 may be disposed vertically above all the orifices 420 having a larger second exterior diameter 427. The arrangement of smaller and larger orifices 420 in this fashion may help reduce carryover between different "beverage doses" (e.g., different consumer's beverage choices) flowing through vertical shaft 400. The arrangement of smaller and larger orifices 420 in this fashion may also decrease the amount of rinse time required to prevent carryover between different beverage doses. For example, in some embodiments, adequate rinsing of hollow interior 432 may be accomplished with a rinsing dose time of 100 milliseconds or less. In some embodiments, adequate rinsing of hollow interior 432 may be accomplished with a rinsing dose time of 50 milliseconds or less.

For syrups with high viscosity and/or high flow rate, a larger orifice 420 may be required to prevent unreasonably high fluidic restriction or pressure drop across the orifice. Generally, syrups requiring higher volumetric flow rate (i.e., lower ratio, such as 5.5:1 ratio syrup) may be injected into a base liquid stream through larger orifices 420. By comparison, syrups requiring lower volumetric flow rate (i.e., higher ratio, such as 30:1 ratio flavor shots) may be injected into a base liquid stream through smaller orifices 420. Orifices 420 for injecting the high flow rate and/or high viscosity syrups may be positioned near the bottom of dispensing manifold 500, furthest away from input port 510. In such embodiments, this allows for a larger base liquid volume to flow across these orifices when a dispensing operation is stopped, and thereby provide a more efficient cleansing of the manifold and nozzle region below these orifices. This helps reduce potential flavor carryover into a subsequent dispensing operation for a different beverage syrup that might otherwise occur if the manifold and nozzle were not adequately rinsed. The low flow rate and/or low viscosity syrups positioned at higher locations in dispensing manifold 500 (i.e., closer to input port 510), are more easily rinsed due to the reduced volume and viscosity of the syrup.

Orifices 420 may be disposed radially about vertical axis 406. Orifices 420 may include a central axis 421 extending through sidewall 431 of vertical shaft 400. In some embodiments, orifices 420 may be oriented in a direction substantially perpendicular to vertical axis 406. In some embodiments, central axes 421 of orifices 420 may be oriented substantially perpendicular to vertical axis 406.

In some embodiments, central axes 421 of orifices 420 may be oriented at an angle relative to vertical axis 406. In some embodiments, central axes 421 of one or more orifices 420 may be oriented at a vertical angle measured relative to a plane perpendicular to vertical axis 406. The vertical angle may be a downward angle. In other words, central axes 421 of one or more orifices 420 may be pointed downward towards a dispensing nozzle (e.g., dispensing nozzle 520) coupled to a lower end 404 of vertical shaft 400. In some embodiments, central axes 421 of one or more orifices 420 may be oriented at a radial angle measured relative to vertical axis 406. The radial angle may be a clockwise angle or a counter-clockwise angle. In other words, central axes 421 of one or more orifices 420 may be oriented at an angle facing clockwise or counter-clockwise around vertical axis 406. Orienting the central axes 421 of orifices 420 downward and/or radially relative to vertical axis 406 may facilitate uniform flow within hollow interior 432.

In some embodiments, vertical shaft 400 may include orifices 420 located on opposing sides of sidewall 431. In some embodiments, one or more orifices 420 may be located directly across from one another on opposite sides hollow interior 432. In some embodiments, orifices 420 located on one side of hollow interior 432 may mirror orifices 420 on the opposite side of hollow interior 432 (i.e., orifices 420 may be symmetrically arranged on opposites of hollow interior 432). In some embodiments, orifices 420 may be offset (either radially and/or vertically) from orifices 420 located across hollow interior 432. In some embodiments, central axes 421 of orifices 420 may be offset (either radially and/or vertically) from central axes 421 of orifices 420 located across hollow interior 432. In some embodiments, orifices 420 may be arranged in rows disposed vertically along sidewall 431 of shaft 430. In some embodiments, orifices 420 may be arranged in vertical rows in a staggered configuration on sidewall 431 of shaft 430. A staggered configuration may increase the number of orifices 420 that may be disposed on a vertical shaft 400 of a particular length. A staggered configuration may result in increased space between ingredient delivery fittings coupled to orifices 420, which may increase the ease of coupling and decoupling ingredient delivery fittings 530 from orifices 420.

Vertical shaft 400 may include any suitable number of orifices 420. In some embodiments, the number of orifices 420 may correspond to the number of ingredients that may be delivered to vertical shaft 400. In such embodiments, each orifice 420 may be coupled to an ingredient delivery fitting 530 that provides a single ingredient to hollow interior 432. In some embodiments, vertical shaft 400 may include at least 4 orifices. In some embodiments, the number of orifices 420 may be a multiple of 4 (e.g., 4, 8, 12, 16, 20, 24, 28, 32, etc.). Other numbers and orientations for orifices 420 may be provided.

In some embodiments, vertical shaft 400 may be a single integrally formed piece (e.g., formed by molding or 3-D printing). In some embodiments, vertical shaft 400 may be a single injection molded piece. In some embodiments, vertical shaft may be composed of a thermoplastic resin. Thermoplastic resins have good chemical compatibility with beverage products and comply with food safety and sanitation regulations. In some embodiments, vertical shaft 400 may be composed of an amorphous thermoplastic with low mold shrinkage to provide good dimensional control. In some embodiments, vertical shaft 400 may be fabricated using a thermoplastic injection molding process. In some embodiments, vertical shaft 400 may be composed of a polymeric material, including but not limited to, polycarbonate, polycarbonate/Polyethylene terephthalate (PET) blends, polyamide, polysulfonate, polyester blends, or a blend or co-polymer thereof. In some embodiments, vertical shaft 400 may be composed of a metallic material, such as but not limited to an aluminum alloy or stainless steel.

The vertical arrangement of dispensing manifold 500 (i.e., the vertical arrangement of vertical shaft 400 and the horizontal arrangement of ingredient delivery fittings 530) creates a compact configuration with a small footprint. This may reduce the amount of floor or counter space needed to accommodate a dispenser with dispensing manifold 500. Moreover, the vertical arrangement of dispensing manifold 500 may allow additional ingredients to be incorporated into dispensing manifold 500 without increasing the footprint of the dispenser with dispensing manifold 500. For example, if one or more orifices 420 is unoccupied by an ingredient delivery fitting 530 or if an ingredient delivery fitting 530 is not connected to an ingredient tube 532, that orifice 420 and fitting 530 may be used to incorporate a new ingredient into dispensing manifold. Additional ingredients may provide users with additional options (e.g., flavor options) for customizing their beverages.

As shown, for example, in FIG. 5, dispensing manifold 500 may include ice chute 270. In some embodiments, dispensing end 276 of ice chute 270 may at least partially surround dispensing nozzle 520. In such embodiments, a beverage may be dispensed from dispensing nozzle 520 and ice may be dispensed from dispensing end 276 of ice chute 270 at a single location (e.g., dispense location 284). In some embodiments, dispensing end 276 may be radially disposed about dispensing nozzle 520. In some embodiments, the central vertical axis of a dispensing passage 277 of dispensing end 276 and the central vertical axis of dispensing nozzle 520 may coincide with each other. In other words, dispensing end 276 of ice chute and dispensing nozzle 520 may be disposed in a co-axial relationship. In some embodiments, the central vertical axis of dispensing passage 277 and the central vertical axis of dispensing nozzle 520 may coincide with vertical axis 406. In some embodiments, dispensing passage 277 may be funnel-shaped.

Figure 6:
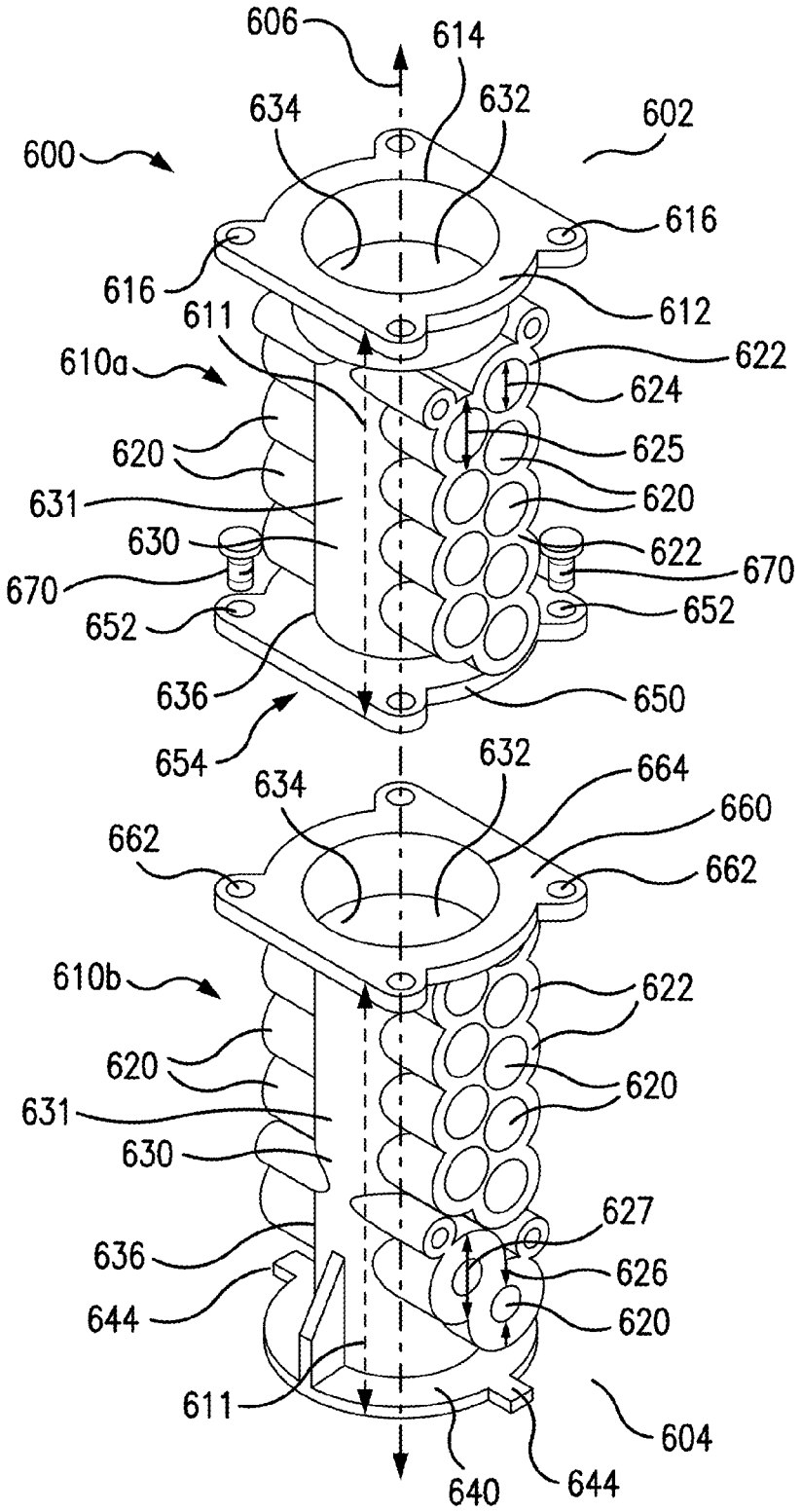
FIG. 6 is an exploded view of a modular dispensing manifold according to an embodiment.

FIG. 6 shows a vertical shaft 600 according to an embodiment. Vertical shaft 600 may be a modular vertical shaft including two or more modules 610. Similar to vertical shaft 400, vertical shaft 600 may include an upper end 602 disposed opposite a lower end 604 in a vertical direction (e.g., in the direction of vertical axis 606 of vertical shaft 600). Vertical axis 606 may be a central vertical axis of vertical shaft 600 (and individual modules 610) extending through the geometrical center of vertical shaft 600 (and individual modules 610) in the vertical direction. In some embodiments, vertical axis 606 may be the vertical axis of rotation for vertical shaft 600 (and individual modules 610).

A module 610 (e.g., upper module 610*a*) may define an upper end 602 of vertical shaft 600 and may include an upper coupling 612 the same as or similar to upper coupling 214. Upper coupling 612 may define an upper opening 614 of upper module 610*a*, and therefore the upper opening of vertical shaft 600. In some embodiments, upper coupling 612 may include holes 616 for receiving fasteners (e.g., fastener 236).

Lower end 604 of vertical shaft 600 may be defined by a module 610 (e.g., lower module 610*b*) and may include a lower coupling 640 the same as or similar to lower coupling 218. Lower coupling 640 may define a lower opening 642 of lower module 610*b*, and therefore the lower opening of vertical shaft 600. In some embodiments, lower coupling 640 may include fasteners 644 (e.g., projections) configured to releasably attach to attachment features (e.g., grooves) formed in a coupling of a dispensing nozzle (e.g., lower coupling 640 and coupling 252 of dispensing nozzle 250 may be attached via a luer-lock connection). In some embodiments, lower coupling 640 and upper coupling 612 may be the same.

Upper module 610*a* may include a bottom coupling 650 configured to attach to a top coupling 660 of lower module 610*b*. In some embodiments, bottom coupling 650 may define a bottom opening 654 of upper module 610*a* and top coupling 660 may define a top opening 664 of lower module 610*b*. In some embodiments, the attachment between bottom coupling 650 and top coupling 660 may be a releasable attachment. The releasable attachment between bottom coupling 650 and top coupling 660 may be any type of releasable attachment discussed herein, or equivalents thereof. In some embodiments, bottom coupling 650 and top coupling 660 may include through holes, 652 and 662 respectively, configured to receive fasteners 670 (e.g., screws or bolts) to releasably attach bottom coupling 650 to top coupling 660. In some embodiments, the releasable attachment between bottom coupling 650 and top coupling 660 may provide a watertight seal. In such embodiments, bottom coupling 650 and/or top coupling 660 may include a seal or gasket, such as an O-ring.

Similar to vertical shaft 400, vertical shaft 600 may include a hollow interior 632 defined by an interior surface 634 of vertical shaft. Hollow interior 632 may be defined by sidewalls 631 of shafts 630 of modules 610 forming vertical shaft 600 (e.g., upper module 610*a* and lower module 610*b*). Hollow interior 632 may define a vertical flow path thorough vertical shaft 600 from upper opening 614 to lower opening 642 of vertical shaft 600. The vertical flow path also passes through top and bottom openings of modules 610 forming vertical shaft 600 (e.g., bottom opening 654 of upper module 610*a* and top opening 664 of lower module 610*b*). Vertical shaft 600 may have an overall length the same as length 407. The overall length of vertical shaft 600 may be equal to the sum of the lengths 611 of individual modules 610. In some embodiments, the lengths of individual modules 610 may be the same. In some embodiments, the lengths 611 of individual modules 610 may be different. In some embodiments, hollow interior 632 may have a cylindrical shape with an interior diameter 608. Interior diameter 608 may be the same as or similar to interior diameter 408.

Vertical shaft 600 may include a plurality of orifices 620 for introducing ingredients into hollow interior 632. Orifices 620 may be formed in sidewalls 631 of modules 610 and may be in communication with hollow interior 632 of vertical shaft 600. In some embodiments, orifices 620 may be in direct communication with hollow interior 632. Orifices 620 may be configured to couple with (e.g., receive) an ingredient delivery fitting (e.g., ingredient delivery fittings 1000 or 1100 discussed herein). Orifices 620 may include an orifice wall 622 extending from an external surface 636 of sidewall 631 of vertical shaft 600. Orifice walls 622 may define an interior diameter and an exterior diameter of orifices 620. In some embodiments, each orifice 620 may include a separate and distinct orifice wall 622. In some embodiments, orifices 620 may share orifice walls 622 (e.g., orifice walls 622 may be integrally formed).

Orifices 620 may be disposed radially about vertical axis 606. Orifices 620 may be the same as or similar to orifices 420. Orifices 620 of vertical shaft 600 may have different sizes (e.g., orifices 620 having different sized interior and/or exterior diameters). For example, as shown in FIG. 6, vertical shaft 600 may include orifices 620 having a first interior diameter 624 and a first exterior diameter 625 and orifices 620 having a second interior diameter 626 and a second exterior diameter 627. The sizes of interior diameters 624/625 and exterior diameters 625/627, as well as the arrangement of small and large orifices 620, may be the same as discussed herein for orifices 420. Orifices 620 may be oriented relative to vertical axis 606 in any of the orientations discussed herein for orifices 420 relative to vertical axis 406. Similarly, orifices 620 may be located and arranged on sidewalls 631 in any of the locations and/or arrangements discussed herein for orifices 420 on sidewall 431.

Vertical shaft 600 may include any suitable number of orifices 620. In some embodiments, the number of orifices 620 may correspond to the number of ingredients that may be delivered to vertical shaft 600. In some embodiments, vertical shaft 600 may include at least 4 orifices and modules 610 may include at least 2 orifices. In some embodiments, the number of orifices 620 on vertical shaft may be a multiple of 4 (e.g., 4, 8, 12, 16, 20, 24, 28, 32, etc.). In some embodiments, the number of orifices 620 on a module 610 may be a multiple of 4.

In some embodiments, modules 610 may be single integrally formed pieces (e.g., formed by molding or 3-D printing). In some embodiments, modules 610 may be single injection molded pieces. In some embodiments, modules 610 may be composed of a polymeric material, including but not limited to, polyethylene, polyurethane, polycarbonate, or a blend or co-polymer thereof. In some embodiments, modules 610 may be composed of a metallic material, such as but not limited to an aluminum alloy or stainless steel.

Figure 7:
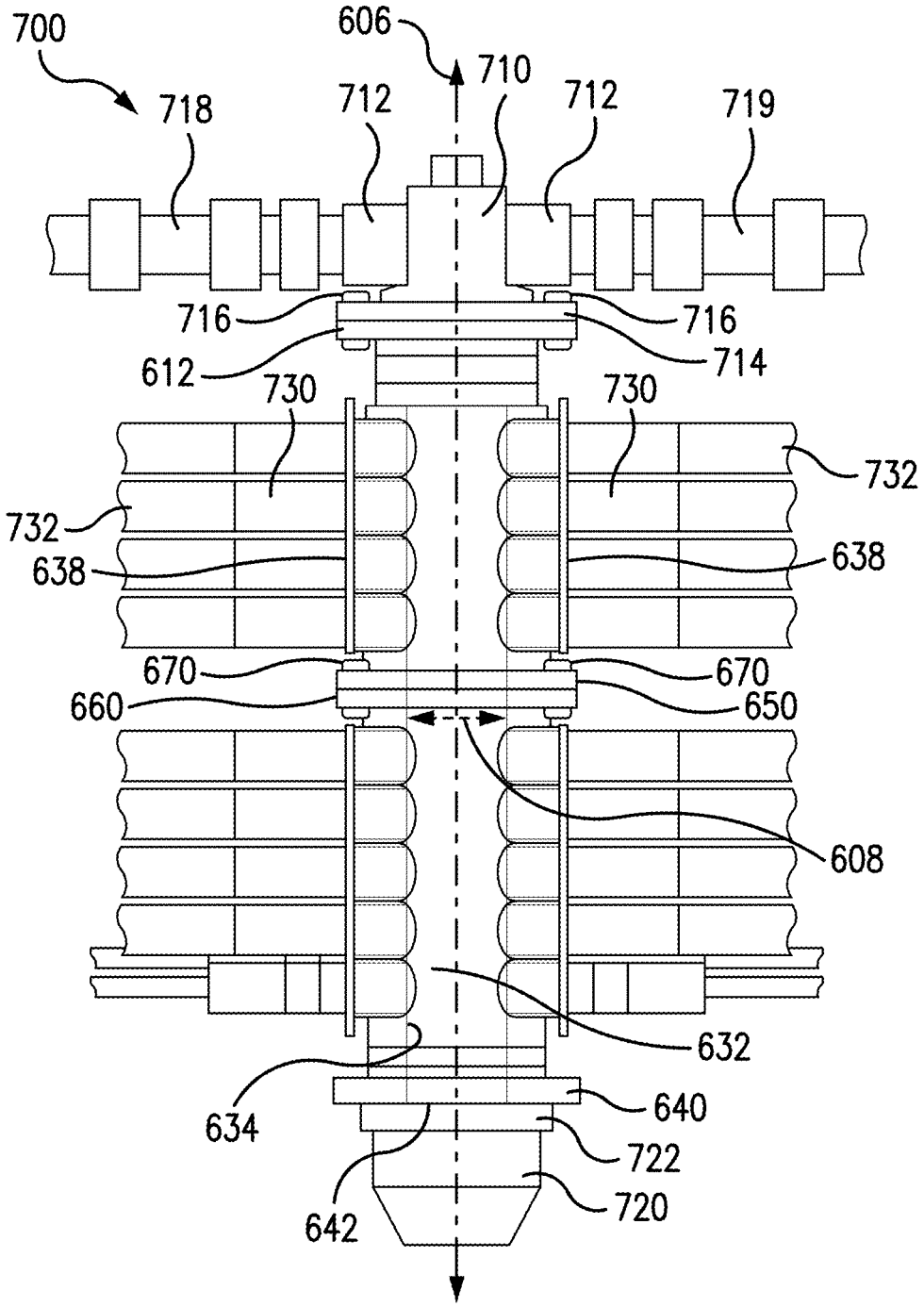
FIG. 7 is a plan view of an assembled modular dispensing manifold according to an embodiment.

FIG. 7 shows a plan view of a dispensing manifold 700 according to an embodiment with a vertical shaft 600. As shown in FIG. 7, modules 610 may be releasably coupled together between an input port 710 and a dispensing nozzle 720 to form a vertical flow path. Input port 710 may be coupled to upper end 602 of vertical shaft 600 via upper coupling 612. Input port 710 may include a coupling 714 and fasteners 716 for attaching to upper coupling 612. In some embodiments, the attachment between coupling 714 and upper coupling 612 may be a releasable attachment such as but not limited to, a threaded attachment, a blot and nut attachment, a luer-lock attachment, a snap-fit attachment, or a combination thereof. In some embodiments, the attachment between coupling 714 and upper coupling 612 may be a non-releasable attachment, e.g., a weld such as an ultrasonic weld. In some embodiments, the attachment between coupling 714 and upper coupling 612 may be watertight. In such embodiments, coupling 714 and/or upper coupling 612 may include a seal or gasket, such as an O-ring.

Input port 710 may include one or more connectors 712 for connecting to a base liquid delivery tube that supplies a base liquid to input port 710. In some embodiments, as shown in FIG. 7, input port 710 may include two connectors 712 for receiving base liquids. In such embodiments, one connector 712 may be coupled to a base liquid delivery tube 718 that delivers carbonated water and the other connector 712 may be coupled to a base liquid delivery tube 719 that delivers non-carbonated water. In some embodiments, input port 710 may include a diffuser the same as or similar to diffuser 518.

As shown in FIG. 7, dispensing manifold 700 may include one or more ingredient delivery fittings 730 coupled to orifice(s) 620. In some embodiments, ingredient delivery fittings 730 may be releasably coupled to orifices 620. In some embodiments, ingredient delivery fittings 730 may be at least partially disposed within orifices 620. In some embodiments, ingredient delivery fittings 730 may extend through orifices 620 to interior surface 634 of vertical shaft 600. In some embodiments, ingredient delivery fittings 730 do not extend past interior surface 634 into hollow interior 632 of the vertical shaft 600 (i.e., the output ends of ingredient delivery fittings 730 do not extend into hollow interior 632). In some embodiments, the output ends of ingredient delivery fittings 730 may be flush with interior surface 634 of hollow interior 632. In some embodiments, the output ends of ingredient delivery fittings 730 may extend slightly into hollow interior 632 (e.g., by approximately ⅛ of an inch). Ingredient delivery fittings 730 may be the same as or similar to ingredient delivery fittings 1000 and 1100 discussed herein.

Ingredient tubes 732 may be connected to ingredient delivery fittings 730 for supplying ingredients to ingredient delivery fittings 730, and therefore hollow interior 632 of vertical shaft 600. Similar to hollow interior 432, hollow interior 632 may act as a mixing chamber for mixing a base liquid flowing through vertical shaft 600 with ingredients received from ingredient delivery fittings. In some embodiments, vertical shaft 600 may include a stop wall 638 configured to hold and/or position ingredient delivery fittings 730 relative to orifices 620 (e.g., within orifices 620). Stop wall 638 may be the same as or similar to stop wall 222.

A dispensing nozzle 720 may be coupled to lower end 604 of vertical shaft 600 via lower coupling 640 and fasteners 644. Dispensing nozzle 720 may include a coupling 722 for attaching to lower coupling 640. In some embodiments, the attachment between coupling 722 and lower coupling 640 may be a releasable attachment such as but not limited to, a threaded attachment, a blot and nut attachment, a luer-lock attachment, a snap-fit attachment, or a combination thereof. In some embodiments, the attachment between coupling 722 and lower coupling 640 may be a non-releasable attachment, e.g., a weld such as an ultrasonic weld. In some embodiments, the attachment between coupling 722 and lower coupling 640 may be watertight. In such embodiments, coupling 722 and/or lower coupling 640 may include a seal or gasket, such as an O-ring. In some embodiments, dispensing manifold 700 may include an ice chute the same as or similar to ice chute 270.

Similar to the vertical arrangement of dispensing manifold 500, the vertical arrangement of dispensing manifold 700 creates a compact configuration with a small footprint. The vertical arrangement of dispensing manifold 700 may allow additional ingredients to be incorporated into dispensing manifold 700 without increasing the footprint of the dispenser with dispensing manifold 700. Additional ingredients may provide users with additional options (e.g., flavor options) for customizing their beverages.

The modularity of vertical shaft 600 may also allow the incorporation of additional ingredients without increasing the footprint of a dispenser. For example, an additional module 610 may added to vertical shaft to add more orifices 620 to vertical shaft 600, thereby increasing the number of ingredients that may be dispensed into hollow interior 632 for mixing with a base liquid. In other words, vertical shaft 600 may create a scalable dispensing manifold. Due to the modularity of vertical shaft 600, modules 610 may be incorporated into vertical shaft 600 with minimal modification/alternation of other components of dispensing manifold 700. For example, an additional module 610 may be incorporated without modification or alteration of input port 710 and dispensing nozzle 720. Similarly, the modularity of vertical shaft 600 may facilitate replacement and/or repair of vertical shaft 600. While FIGS. 6 and 7 show a vertical shaft with two modules 610, vertical shaft may include any suitable number of modules, such as three, four, or five modules 610.

Figure 8:
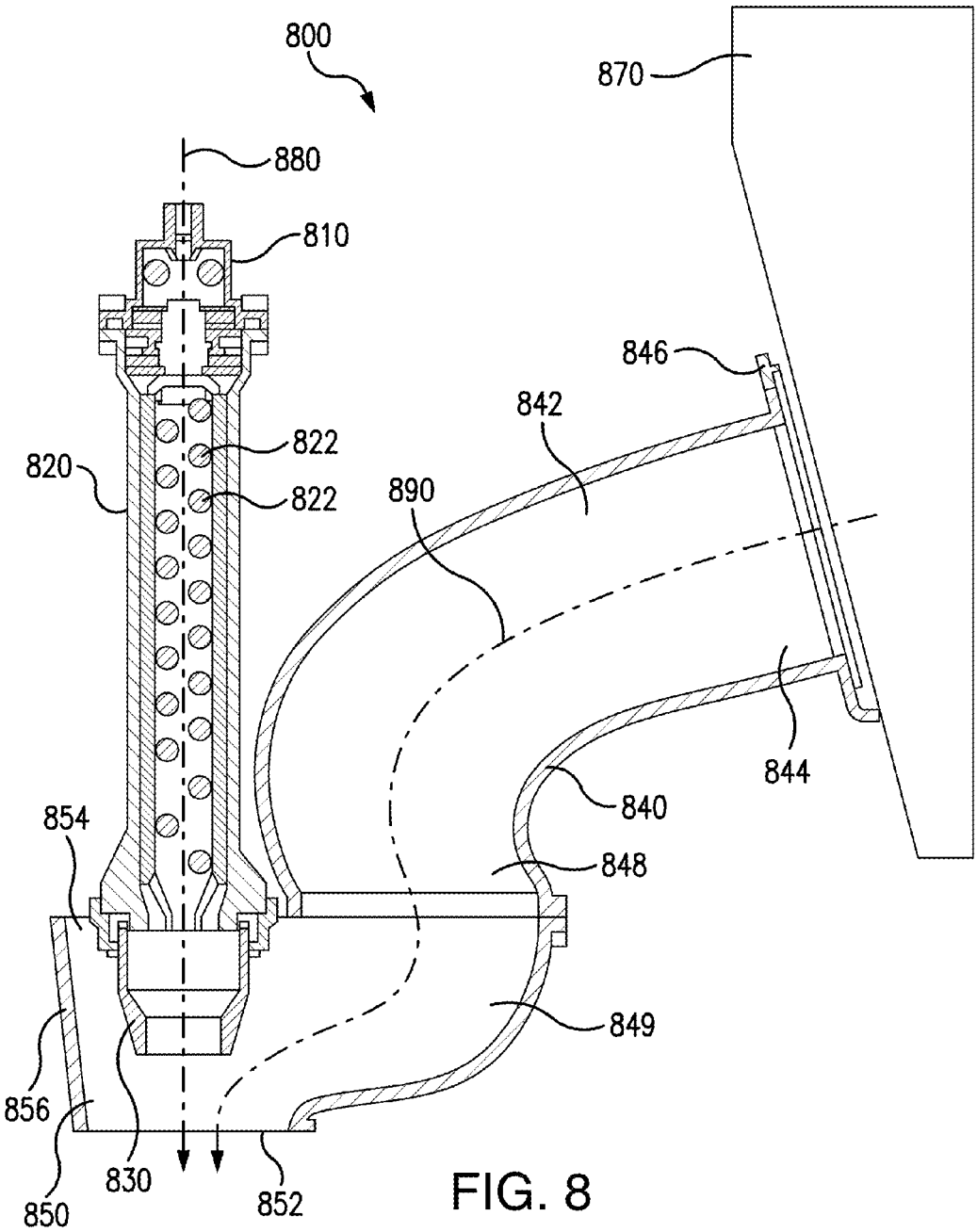
FIG. 8 is a cross-sectional view of a dispensing manifold and an ice chute according to an embodiment.
Figure 9:
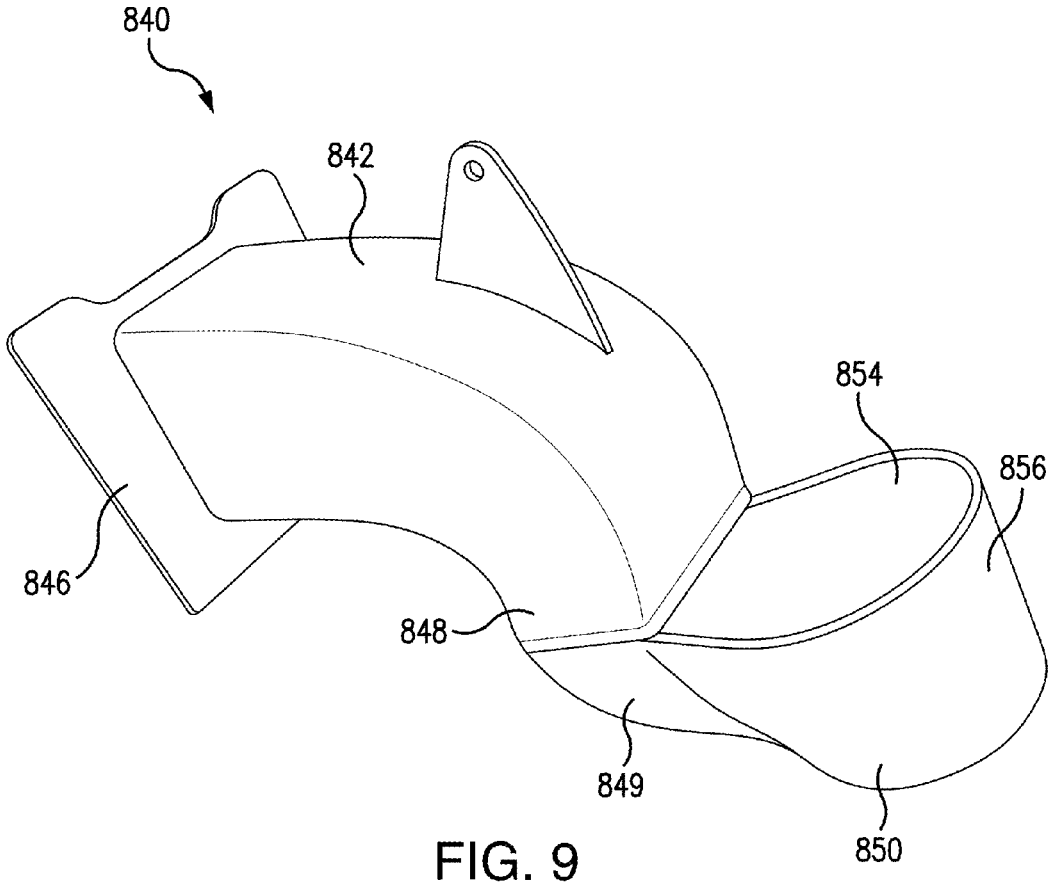
FIG. 9 is a perspective view of an ice chute according to an embodiment.

FIG. 8 shows a cross-sectional view of a dispensing manifold 800 according to an embodiment. Dispensing manifold 800 may include an input port 810 for introducing a base liquid, a vertical shaft 820, and a dispensing nozzle 830 for dispensing a beverage along a beverage flow path 880 (e.g., a vertical axis of vertical shaft 820). Vertical shaft 820 may include a plurality of orifices 822 for introducing ingredients into vertical shaft 820 along beverage flow path 880. Dispensing manifold 800 may include an ice chute 840 for dispensing ice along an ice flow path 890. A perspective view of ice chute 840 is shown in FIG. 9.

Ice chute 840 may include a channel 842 with a dispensing end 850 surrounding at least a portion of dispensing nozzle 830 and a supply end 844 coupled to an ice reservoir 870. Supply end 844 of ice chute 840 may be releasably coupled to ice reservoir 870 via a coupling 846. Ice reservoir 870, which may be referred to as an ice hopper, may comprise a door that has an open position to allow ice to exit ice reservoir 870 and enter ice chute 840, and a closed position to keep ice from exiting ice reservoir 870. The door may have a guillotine-type configuration (e.g., door may slide up to the open position and slide down to the closed position). In some embodiments, ice reservoir 870 may have an auger located inside ice reservoir 870 to reduce or prevent ice from clumping within ice reservoir 870. The auger may be at or near the bottom of the ice reservoir 870 adjacent to supply end 844 of ice chute 840. In some embodiments, a moving arm or slinger in ice reservoir 870 may be provided to move around within ice reservoir 870 to push ice from ice reservoir 870 to ice chute 840.

Dispensing end 850 of ice chute 840 may include a dispensing passage 856 surrounding at least a portion of dispensing nozzle 830. This may allow a beverage to be dispensed from dispensing nozzle 830 and ice to be dispensed from ice chute 840 at the same location (e.g., in a cup at dispense location 284). In some embodiments, a beverage and ice may be dispensed at the same location at the same time. In some embodiments, dispensing passage 856 may be radially disposed about dispensing nozzle 830. In some embodiments, dispensing passage 856 of ice chute 840 and dispensing nozzle 830 may be disposed in a co-axial relationship. In some embodiments, the central vertical axis of dispensing passage 856 and the central vertical axis of dispensing nozzle 830 may coincide with beverage flow path 880. In some embodiments, dispensing passage 856 may be funnel-shaped.

In some embodiments, supply end 844 of ice chute 840 may be angled slightly downward so that ice leaving ice reservoir 870 initially flows in channel 842 at a slight downward angle. This slight angle of channel 842 may continue towards a throat 848 of ice chute 840. Throat 848 may be angled steeply downward relative to supply end 844 (e.g., may be angled straight downwards). Throat 848 may be connected to a bowl 849 that includes a curved wall that transitions from the steep vertical angle of throat 848 to a slight downward angle the same as or similar to the slight downward angle of supply end 844. Bowl 849 may connect to dispensing passage 856 at dispensing end 850 of ice chute 840.

Together, supply end 844, throat 848, bowl 849, and dispensing passage 856 may define an ice flow path 890 having an S-shape. In some embodiments, the shape of throat 848, bowl 849, and dispensing passage 856 may create a swirling flow of ice as it exits a dispensing opening 852 at dispensing end 850. A swirl type flow of ice may reduce the vertical velocity of ice exiting ice chute 840, which may reduce splashing and carbonation release of a beverage within a user's cup positioned below dispensing end 850.

Dispensing passage 856 may include a nozzle opening 854 disposed vertically above dispensing opening 852. In other words, dispensing passage 856 may be a hollow shaft defining nozzle opening 854 and dispensing opening 852. In some embodiments, nozzle opening 854 may extend from throat 848 of ice chute 840. Nozzle opening 854 may be configured to receive all or a portion of dispensing nozzle 830. In some embodiments, e.g., as shown in FIG. 8, dispensing nozzle 830 may be received within nozzle opening 854 such that it is positioned adjacent to bowl 849.

Figure 10A:
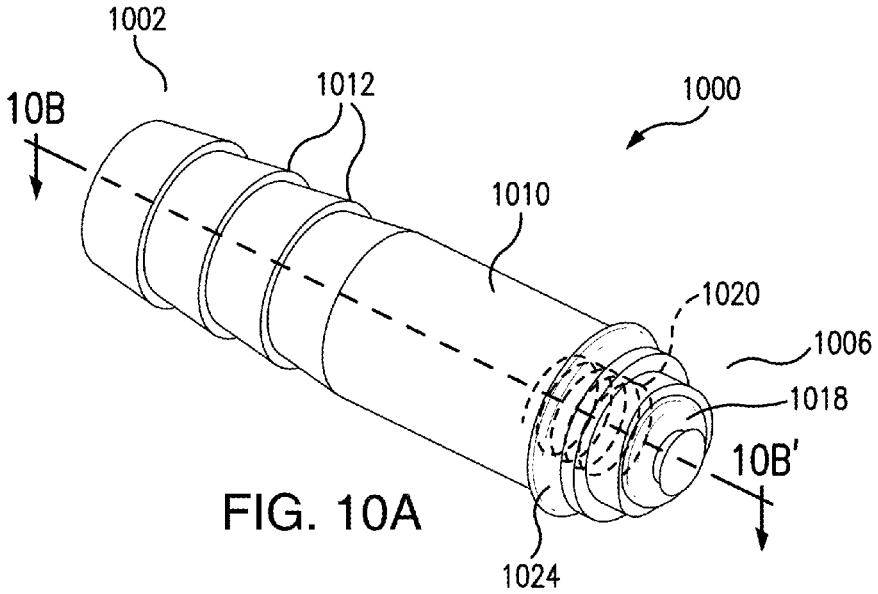
FIG. 10A is a perspective view of an ingredient delivery fitting according to an embodiment.
Figure 10B:
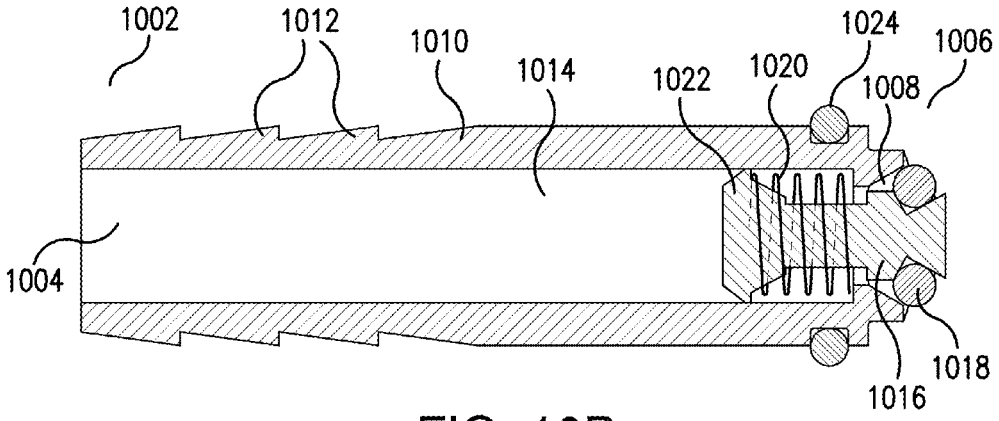
FIG. 10B is a cross-sectional view of the ingredient delivery fitting in FIG. 10A along the line 10B-10B' in FIG. 10A.

FIGS. 10A and 10B show an ingredient delivery fitting 1000 according to an embodiment. Ingredient delivery fitting 1000 includes a hollow body 1010 with an input end 1002 and an output end 1006 separated by a passageway 1014. Hollow body 1110 may include barbs 1012 positioned adjacent to input end 1002 and configured to frictionally couple an ingredient delivery tube around opening 1004 at input end 1002. In some embodiments, ingredient delivery fitting 1000 may include a seal ring 1024 configured to sealing couple to an interior surface (e.g., interior diameter) of an orifice (e.g., orifices 420 and 620). In some embodiments, seal ring 1024 may additionally or alternatively be configured to engage a stop wall of a vertical shaft (e.g., stop wall 438 of vertical shaft 400) when ingredient delivery fitting 1000 is coupled to an orifice 420. In some embodiments, seal ring 1024 may be an O-ring. In some embodiments, ingredient delivery fitting 1000 may include a projection (e.g., a flange) disposed on hollow body 1010 for engaging stop wall 438 of vertical shaft 400 when ingredient delivery fitting 1000 is coupled to an orifice 420.

When ingredient delivery fitting 1000 is coupled to an orifice (e.g., received within orifice 420 or 620), an opening 1008 of output end 1006 may be in communication with a hollow interior of a vertical shaft (e.g., hollow interior 432 of vertical shaft 400) for dispensing an ingredient into the vertical shaft. In some embodiments, output end 1006 may be in direct communication with hollow interior 432. For example, output end 1006 may be flush with interior surface 434 of hollow interior 432 or may extend slightly into hollow interior. In some embodiments, output end 1006 may extend into hollow interior 432 by approximately ⅛ of an inch.

Ingredient delivery fitting 1000 may include a valve 1016 configured to control the flow of an ingredient through ingredient delivery fitting 1000 and dispensing of the ingredient from an opening 1008 at output end 1006. Valve 1016 may be configured to open and close opening 1008. Valve 1016 may be a pressure sensitive valve, such as an umbrella valve. Valve 1016 may include a plunger 1022, an elastic member 1020 (e.g., a spring), and a seal 1018. Elastic member 1020 may bias valve 1016 in the closed position with seal 1018 sealing opening 1008 (e.g., as shown in FIGS. 10A and 10B). When pressure is applied to valve (e.g., via a controller operating a pump and/or valve to push an ingredient towards output end 1006 of ingredient delivery fitting 1000), plunger 1022 may compress elastic member 1020 and force seal 1018 out of opening 1008. Once seal 1018 is forced out of opening, an ingredient may flow through passage 1014 and out of opening 1008. When pressure is removed, elastic member 1020 may re-expand, thereby pulling seal 1018 back into opening 1008, closing opening 1008, and preventing dispensing of the ingredient. In some embodiments, seal 1018 may be an O-ring.

Ingredient delivery fitting 1000 functions to provide a positive shut-off and isolation of a beverage ingredient (e.g., a syrup) from the interior of a vertical manifold when a dispensing operation ceases. Ingredient delivery fitting 1000 prevents migration of the ingredient into the vertical manifold during idle periods, or when beverages with different ingredients are being dispensed, thus reducing undesirable flavor carry over into other beverage drinks.

Figure 11A:
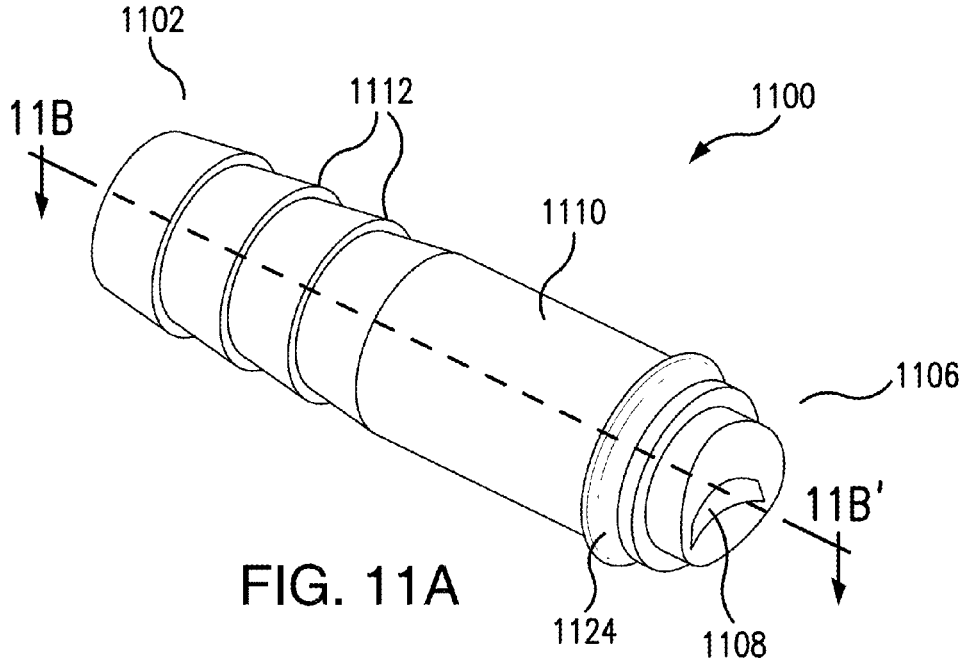
FIG. 11A is a perspective view of an ingredient delivery fitting according to an embodiment.
Figure 11B:
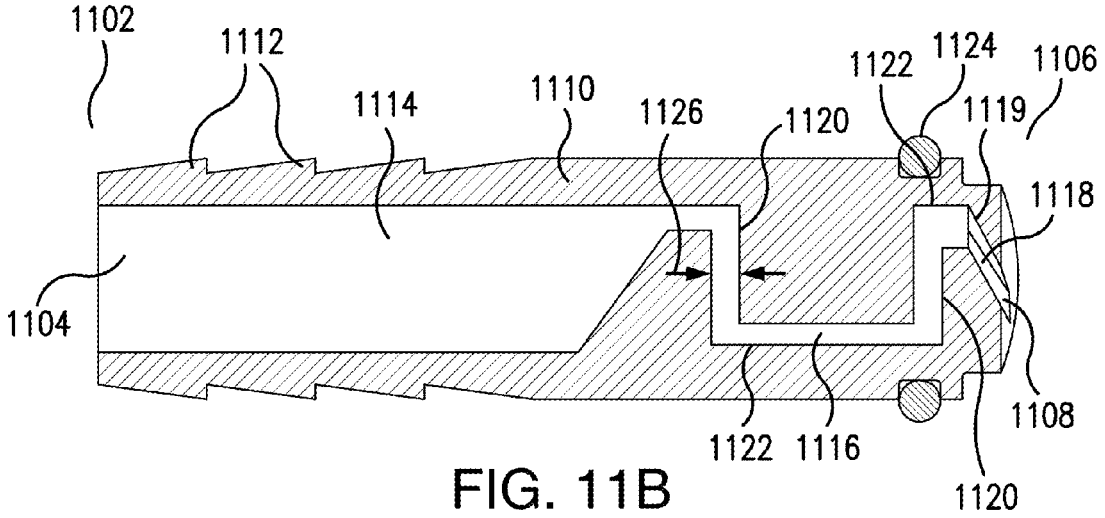
FIG. 11B is a cross-sectional view of the ingredient delivery fitting in FIG. 11A along the line 11B-11B' in FIG. 11A.

FIGS. 11A and 11B show an ingredient delivery fitting 1100 according to an embodiment. Ingredient delivery fitting 1100 includes a hollow body 1110 with an input end 1102 and an output end 1106 separated by a passageway 1114. Hollow body 1110 may include barbs 1112 positioned adjacent to input end 1102 and configured to frictionally couple an ingredient delivery tube around opening 1104 at input end 1102. In some embodiments, ingredient delivery fitting 1100 may include a seal ring 1124 configured to sealing couple to an interior surface (e.g., interior diameter) of an orifice (e.g., orifices 420 and 620). In some embodiments, seal ring 1124 may additionally or alternatively be configured to engage a stop wall of a vertical shaft (e.g., stop wall 438 of vertical shaft 400) when ingredient delivery fitting 1100 is coupled to an orifice 420. In some embodiments, seal ring 1124 may be an O-ring. In some embodiments, ingredient delivery fitting 1100 may include a projection (e.g., a flange) disposed on hollow body 1110 for engaging stop wall 438 of vertical shaft 400 when ingredient delivery fitting 1100 is coupled to an orifice 420.

Passageway 1114 may include a labyrinth flow path 1116 configured to control the flow of an ingredient through ingredient delivery fitting 1100. Labyrinth flow path 1116 may include one or more vertical paths 1120 and one or more horizontal paths 1122. In some embodiments, labyrinth flow path 1116 may include a slanted path 1118 located at output end 1106 and terminating at a spout 1108 on output end 1106. Labyrinth flow path 1116 may restrict the flow of an ingredient through ingredient delivery fitting 1100. Labyrinth flow path 1116 may be sized and shaped to prevent flow of an ingredient unless the pressure of the ingredient within labyrinth flow path 1116 exceeds a certain level. In some embodiments, labyrinth flow path 1116 may include a polygonal cross-sectional shape. In some embodiments, labyrinth flow path 1116 may include a circular cross-sectional shape.

In some embodiments, labyrinth flow path 1116 may include a cross-sectional width 1126 (e.g., diameter) in the range of 0.5 millimeters to 2.0 millimeters. A width in this range is small enough so that the surface tension of an ingredient (e.g., a syrup) is activated to cause adhesion to the walls of labyrinth flow path 1116. This helps to reduce ingredient migration into a vertical manifold during idle periods or when beverages with different ingredients are being dispensed, and helps reduce undesirable flavor carry over into other beverage drinks.

The restricted flow of an ingredient through labyrinth flow path 1116 may be used to control the flow of an ingredient through ingredient delivery fitting 1100. Pressure may be applied (e.g., via a controller operating a pump and/or valve to push an ingredient towards output end 1106 of ingredient delivery fitting 1100). Labyrinth flow path 1116 may be configured to allow flow of an ingredient once pressure exceeds a certain level (e.g., a specific psi) and prevent flow of the ingredient when the pressure is below that level. In other words, when the pressure of an ingredient within ingredient delivery fitting 1100 exceeds a certain level, the ingredient may flow through labyrinth flow path 1116 and may be dispensed from spout 1108, and when the pressure falls below a certain level, no ingredient may be dispensed from spout 1108.

Slanted path 1118 of labyrinth flow path 1116 may inhibit carry-over between different beverage doses. When coupled to an orifice, slanted flow path 1118 may be angled downward (e.g., towards a dispensing nozzle coupled to lower end 404 vertical shaft 400). The downward angle may help prevent base liquid and other ingredients flowing downward in a vertical shaft from entering ingredient delivery fitting 1100. The downward angle of slanted path 1118 may also inhibit residual ingredient located in labyrinth flow path 1116 from being undesirably dispensed into a hollow interior (e.g., hollow interior 432 of vertical shaft 400). When coupled to an orifice, an interior end 1119 of slanted flow path 1118 may be coupled to a horizontal path 1122 located at the highest vertical position on ingredient delivery fitting 1100. This may prevent residual ingredient from undesirably dripping from spout 1108, thereby preventing carryover and/or undesired mixing of ingredients during dispensing.

The size (e.g., length and diameter) of ingredient delivery fittings 1000/1100 may be tailored for certain ingredients.

For example, a larger ingredient delivery fitting may be used to dispense a more viscous ingredient compared to the size of an ingredient delivery fitting for a less viscous ingredient.

Figure 12:
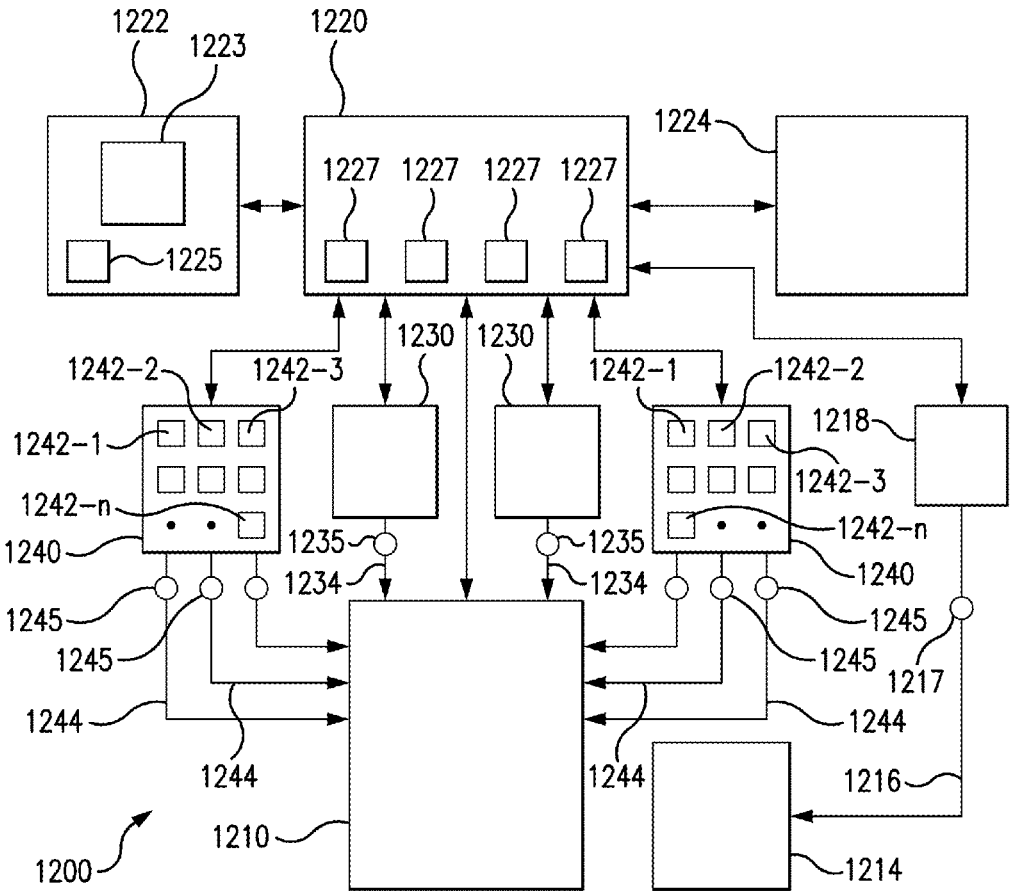
FIG. 12 is a schematic diagram of a dispensing system according to an embodiment.

FIG. 12 shows a beverage dispensing system 1200 according to an embodiment. Beverage dispensing system 1200 may include one or more beverage dispensers 1210. Beverage dispenser 1210 may include a vertical dispensing manifold the same as or similar to vertical dispensing manifold 200, 500, or 700 discussed herein. Dispensing system 1200 may include an ice dispenser 1214 coupled to an ice reservoir 1218. Ice dispenser 1214 may include an ice chute 1216 coupled to ice reservoir 1218. Ice chute 1216 may be the same as or similar to ice chute 270 or 840 discussed herein. A valve 1217, such as a guillotine-type door, may control the flow of ice from ice reservoir 1218 into ice chute 1216.

Dispensing system 1200 may include one or more base liquid sources 1230. Base liquid sources 1230 may be, but are not limited to, a tap water source (e.g., tap water line) and a carbonated water source (e.g., carbonated water reservoir or carbonator). Base liquid sources 1230 may be coupled to dispenser 1210 via base liquid delivery tubes 1234. Valves/pumps 1235 in communication with base liquid delivery tubes 1234 may be configured to control the flow of base liquid through base liquid delivery tubes 1234 and into beverage dispenser 1210.

Dispensing system 1200 may include one or more ingredient sources 1240. Ingredient sources 1240 may include a plurality of ingredients 1242 (1242-1 through **1242-*n*). Ingredients 1242 may include liquid ingredients, such as but not limited to, sweeteners (e.g., sugars or artificial sweeteners), syrups or flavorings (e.g., cola syrups or flavorings, brand soda syrups or flavoring (e.g., Mountain Dew® or Sierra Mist®), orange flavoring, lime flavoring, cherry flavoring, tea flavorings, etc.), or other liquid additives (e.g., vitamins, acids (e.g., citric acid), salts, or colorings). Ingredients 1242 may be packaged within a container, such as but not limited to a cartridge or bag. Each ingredient 1242 may be delivered to dispenser 1210 via ingredient delivery tubes 1244 coupled to ingredient delivery fittings (e.g., ingredient delivery fittings 1000 or 1100). Valves/pumps 1245 in communication with ingredient delivery tubes 1244 may be configured to control the flow of ingredients through ingredient tubes 1244 and into beverage dispenser 1210**.

In dispensing systems 1200 including multiple beverage dispensers 1210, beverage dispensers 1210 may share base liquid source(s) 1230 and/or ingredient source(s) 1240. In some embodiments, each beverage dispenser 1210 in a dispensing system 1200 may have its own dedicated base liquid source(s) 1230 and/or ingredient source(s) 1240.

A controller 1220 may be configured to control operations (e.g., dispensing of a beverage and/or ice) of dispensing system 1200. In some embodiments, controller 1220 may include and/or may be configured to read sensors 1227 associated with dispensing system 1200. Sensors 1227 may include pressure sensors for monitoring the pressure of a base liquid within a base liquid delivery tube 1234 and/or for monitoring the pressure of an ingredient within an ingredient delivery tube 1244 and/or ingredient delivery fitting. Sensors 1227 may also include flow sensors (e.g., flow meters) for measuring the flow of base liquids and ingredients within delivery tubes 1234 and 1244, respectively, and/or for measuring the degree of uniform flow within a vertical shaft (e.g., vertical shaft 400) of dispenser 1210. In some embodiments, sensors 1227 may include level sensors for measuring the amount of each ingredient 1242 remaining within an ingredient source 1240.

Sensors 1227 may also include, but are not limited to sensors configured to monitor (1) carbon dioxide tank levels (e.g., one, two or more carbon dioxide regulators); (2) carbonization head pressure of a carbonator configured to carbonate water; (3) ambient temperature of a room (e.g., a backroom) in which base liquids and/or ingredients are stored (thereby monitoring whether one or more base liquids and/or ingredients are maintained at pre-determined temperature level or within a pre-determined temperature range); (4) water filtration system parameters (e.g., water pressure, differential pressure on filters); (5) pH of water or carbonated water; (6) the expiration date of an ingredient container (e.g., buy reading a bar code associated within an ingredient container). Sensors 1227 may be connected to an input/output ("I/O") rack or device, and may be configured to transmit or receive signals over a wired or wireless network to controller 1220. Controller 1220 may be configured to control the operations of dispensing system 1200 based on data (e.g., pressure and flow values) collected by sensors 1227.

In some embodiments, dispensing system 1200 may include a user interface 1222. User interface 1222 may include a display 1223 for displaying information to a user (e.g., a liquid crystal display (LCD) or a light emitting diode (LED) display). User interface 1222 may include user inputs (e.g., buttons or a touch screen with icons (which may or may not be integrated into display 1223)) for receiving commands from a user. Controller 1220 may be configured to control display 1223 and receive commands from user interface 1222.

User interface 1222 may allow a user to control various aspects of dispensing system 1200. For example, user interface 1222 may allow a user to initiate dispensing of a beverage and/or ice. User interface 1222 may also allow a user to select different beverage types and/or ingredients for dispensing. A user may customize his or her beverage by selecting beverage and/or ingredient options on user interface 1222. In some embodiments, user interface 1222 may allow a user to input a user identification code (e.g., a user name or phone number) to identify a particular user. In some embodiments, user interface 1222 may include a scanner 1225 (e.g., a barcode scanner, radio frequency identification (RFID) reader, or quick response (QR) code scanner) configured to read a user's identification code. In such embodiments, a user may be identified by allowing scanner 1225 to read his or her identification code.

In some embodiments, dispensing system 1200 may include a remote controller 1224. Remote controller 1224 may be, for example, a local area computer, a network computer, or a server. Remote controller 1224 may be in communication with controller 1220 via a wired or wireless connection. Remote controller 1224 may send information to controller 1220. For example, remote controller 1224 may be configured to send software updates to controller 1220. Software updates may provide controller 1220 with updated user interface software for displaying information to users on display 1223. In some embodiments, software updates may include, for example, new icons for new types of beverages that may be dispensed from beverage dispenser 1210 or new ingredients (e.g., flavors) that may be added to a beverage dispensed from beverage dispenser 1210. In some embodiments, software updates may include drink construction formulations for new beverage products.

In some embodiments remote controller 1224 may collect dispenser information from controller 1220. Dispenser information collected from controller 1220 may include but is not limited to: (1) amounts of beverages and types of beverages dispensed by beverage dispenser 1210, (2) types of ingredients and amounts of ingredients 1242 remaining in ingredient sources 1240, (3) user identification codes, and (4) data from sensors 1227 (e.g., uniform flow data). In some embodiments, remote controller 1224 may store the dispenser information. In some embodiments, the dispenser information may be used to aid in the distribution of ingredients to different dispensing systems 1200. In some embodiments, the dispenser information may be used to track user preferences. In some embodiments, remote controller 1224 may be in communication with a plurality dispensing systems 1200, which may or may not be remotely located from each other (e.g., located at different venues).

In some embodiments, controller 1220 may use the dispenser information to alter aspects of beverage dispenser 1210, such as information displayed on display 1223 of user interface 1222. For example, if controller 1220 determines that an ingredient 1242 has run out or that an ingredient is currently incapable of delivery to beverage dispenser 1210 (e.g., by measuring level sensors and/or pressure sensors), controller 1220 may be configured to remove that ingredient 1242 choice from user interface 1222. This may prevent a user from receiving a "sold-out" or "unavailable" message. As another example, if controller 1220 determines that the flow of a beverage through a vertical shaft is non-uniform, controller 1220 may be configured to alter the flow characteristics (e.g., pressure or volume per unit time) of a base liquid and/or ingredients within the vertical shaft to return the flow to a uniform flow. This may prevent a non-homogenous beverage from being dispensed from dispenser 1210. In some embodiments, controller 1220 may be configured to detect possible carryover or undesirable mixing of ingredients within a vertical shaft. For example, controller may monitor pressure values within ingredient delivery tubes 1244 and/or ingredient delivery fittings to determine whether or not an ingredient is being undesirably dispensed in a vertical shaft.

Controller 1220 may be configured activate an alarm when a predetermined condition occurs, e.g., when the level of an ingredient 1242 falls below a predetermined level, when a "freshness" date or "use by" date for an ingredient 1242 is a predetermined time from expiring, when possible carryover is occurring, or when flow within a vertical shaft is non-uniform. The alarm may be a visual and/or audible alarm. In some embodiments, the alarm may be in the form of an electronic message (e.g., text message or email message) to a specific individual (e.g., an owner/operator) of a venue. In this manner, controller 1220 may be configured to provide users with consistent and reliable dispensing of selected beverages from a beverage dispenser 1210.

In some embodiments, controller 1220 may use the types of ingredients available at a beverage dispenser 1210 and a user identification code to customize the information displayed on display 1223 for a specific user. For example, a controller 1220 may be configured to display a greeting message with the user's name and the user's most selected beverage choices (e.g., the user's favorite beverages). In some embodiments, controller 1220 may track user preferences and alert an entrepreneur that purchasing an addition module 610 may be beneficial. For example, if controller 1220 determines that a large number of an entrepreneur's customers prefer a certain beverage and/or beverage flavoring, controller 1220 may alert the entrepreneur that an additional module 610 for incorporating additional beverage and/or flavor choices into the beverage dispenser at the entrepreneur's venue may be beneficial. This may also be beneficial for the manufacturer and/or distributor of a beverage dispenser because it may increase user satisfaction with manufacturer's and/or distributor's beverage dispenser.

Controller 1220 may control the dispensing of beverages and ice from beverage dispenser 1210 and ice dispenser 1214, respectively. Controller 1220 may control the dispensing of ice by controlling valve 1217. Controller 1220 may open and close valve 1217 in response to a user input received from user interface 1222. Controller 1220 may be configured to dispense different amounts of ice depending on a user's selection. For example, buttons or touchscreen icons may be provided on user interface 1222 for a "standard" amount of ice, a "large" amount of ice, and a "small" amount of ice.

Controller 1220 may control the dispensing of a beverage, which may be a mixture of a base liquid and one more ingredients 1242 from beverage dispenser 1210. Controller 1220 may control the flow of a base liquid from base liquid sources 1230 by controlling valve/pumps 1235. As such, controller 1220 may be configured to control the delivery of a base liquid into a hollow interior of a vertical shaft (e.g., hollow interior 432 of vertical shaft 400). Controller 1220 may also control the flow of ingredients 1242 from ingredient sources 1240 by controlling valves/pumps 1245. By controlling valves/pumps 1245, controller 1220 may control the pressure of an ingredient 1242 within ingredient tubes 1244, and therefore the pressure of the ingredient 1242 within ingredient delivery fittings (e.g., ingredient delivery fittings 1000 and 1100). As such, controller 1220 may be configured to control the delivery of ingredients 1242 into a hollow interior of a vertical shaft (e.g., hollow interior 432 of vertical shaft 400). In some embodiments, controller 1220 may be configured to dispense ice from ice dispenser 1214, via ice chute 1216, and dispense a beverage (e.g., a base liquid mixed with one or more ingredients) from beverage dispenser 1210 simultaneously.

Figure 13:
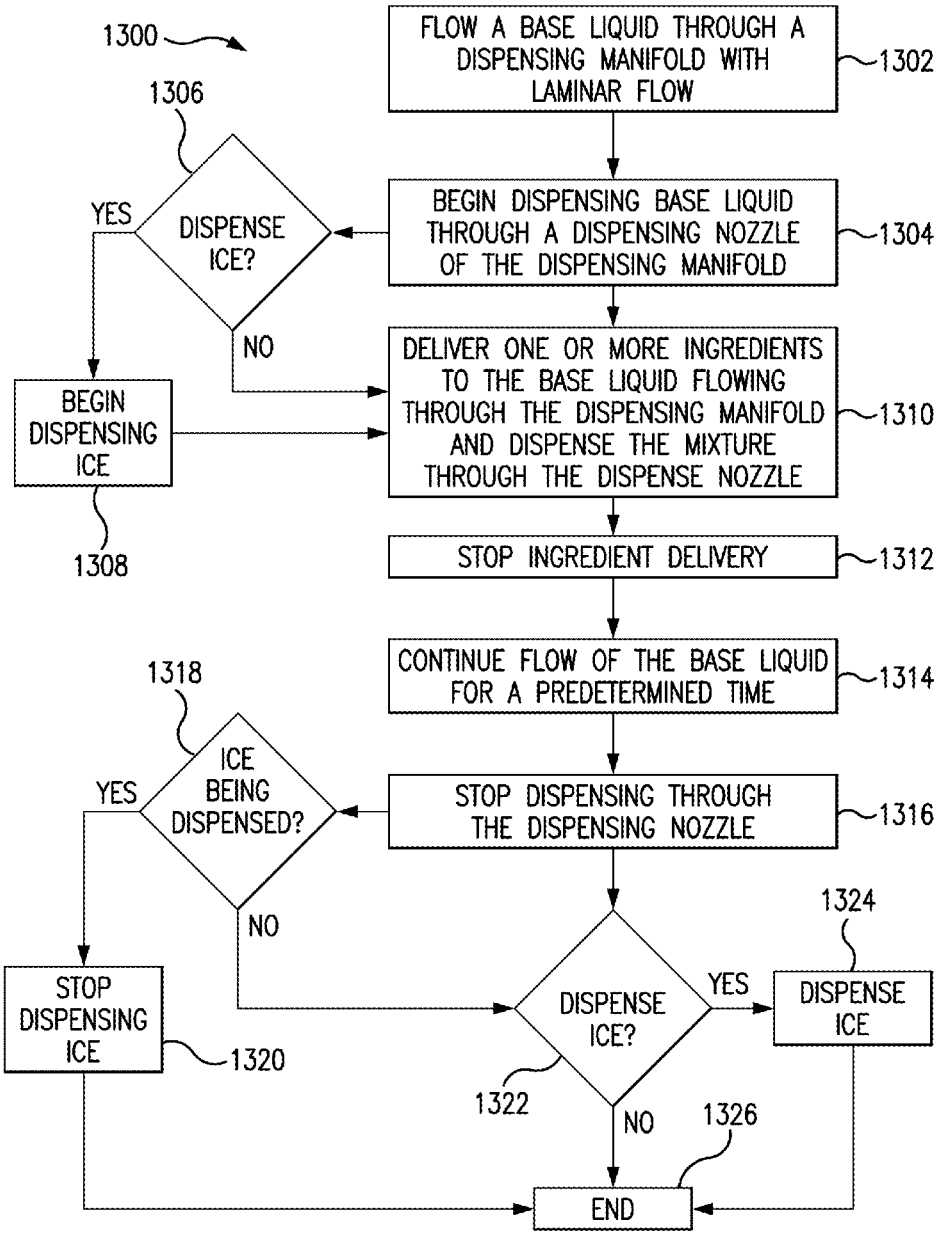
FIG. 13 is a flow chart illustrating a method of dispensing a beverage according to an embodiment.

FIG. 13 shows a method 1300 of dispensing a beverage according to an embodiment. When controller 1220 receives a command to dispense a beverage, controller 1220 may initiate the flow of a base liquid through a dispensing manifold (e.g., dispensing manifold 500) in step 1302. The flow of a base liquid may include a uniform flow through a hollow interior of a vertical shaft (e.g., hollow interior 432 of vertical shaft 400). As the flow of base liquid continues, base liquid may begin dispensing from a dispensing nozzle (e.g., dispensing nozzle 520) in step 1304. In some embodiments, base liquid may flow and may be dispensed from a dispensing nozzle 520 in step 1304 for a predetermined time (e.g., 100 milliseconds or 50 milliseconds) before ingredient delivery begins in step 1310 to rinse hollow interior 432 and dispensing nozzle 520.

In some embodiments, controller 1220, either automatically or in response to a command from user interface 1222, may be configured to begin dispensing ice when base liquid begins dispensing from dispensing nozzle 520 in step 1304. In step 1306, controller 1220 may determine whether or not to start dispensing ice. If controller 1220 determines that ice is not to be dispensed in step 1306, controller 1220 may proceed to step 1310. If controller 1220 determines that ice should be dispensed, it may begin dispensing ice in step 1308 and then proceed to step 1310.

In step 1310, controller 1220 may deliver one or more ingredients 1242 into the base liquid flowing through hollow interior 432 of vertical shaft 400 via orifices 420 formed in vertical shaft 400 (e.g., by controlling the pressure of ingredients 1242 within ingredient delivery tubes 1244 and ingredient delivery fittings). Controller 1220 may introduce a specific combination and amount of ingredients based on a user's selection(s) received from user interface 1222. For example, controller 1220 may be configured to introduce a cola flavoring, a cherry favoring, and an artificial sweetener in the event a user selects a diet cherry flavored cola beverage. As another example, controller 1220 may be configured to introduce an orange flavoring, an artificial sweetener, and a sugar in the event a user selects a half-calorie orange flavored beverage. In some embodiments, the introduction of ingredients 1242 in step 1310 may being at approximately the same time as base liquid begins flowing through dispensing nozzle 520 in step 1304. While flowing both the base liquid and one or more ingredients in step 1310, a mixed beverage including the base liquid and one or more ingredients 1242 may be dispensed from dispensing nozzle 520 (e.g., at dispense location 284).

Once controller 1220 delivers the appropriate types and amounts of ingredients 1242, controller 1220 may stop the delivery of ingredients 1242 in step 1312. Controller 1220 may be configured to continue the flow of a base liquid through hollow interior 432 in step 1314 for a predetermined amount of time. The continued flow of the base liquid in step 1314 may rinse hollow interior 432 and dispensing nozzle 520. In some embodiments, the predetermined amount of time in step 1314 may be 100 milliseconds or less. In some embodiments, the predetermined amount of time in step 1314 may be 50 milliseconds or less. The rinsing of hollow interior 432 and dispensing nozzle 520 may prevent carry-over between different beverage doses. For example, the cherry cola flavor for one user's beverage may not carry over into the next user's orange flavored beverage.

In step 1316, controller 1220 may be configured to stop the flow of base liquid from dispensing nozzle 520. After stopping the flow of base liquid in step 1316, controller 1220 may determine whether or not ice is being dispensed in step 1318. If ice is being dispensed, controller 1220 may stop dispensing ice is step 1320 and end the dispensing operation in step 1326. If ice is not currently being dispensed, controller 1220 may be configured to determine whether or not to dispense ice in step 1322. If controller 1220, either automatically or in response to a command from user interface 1222, determines that ice should be dispensed in step 1322, controller 1220 may begin dispensing ice in step 1324. Once ice dispensing is finished, controller 1220 may end the dispensing operation in step 1326. If controller 1220 determines that ice is not to be dispensed in step 1322, controller 1220 may end the dispensing operation in step 1326. While method 1300 includes dispensing a beverage and ice, controller 1220 may be configured to dispense a beverage and/or ice without dispensing the other. In some embodiments, ice may be dispensed before dispensing a beverage.

Figure 14:
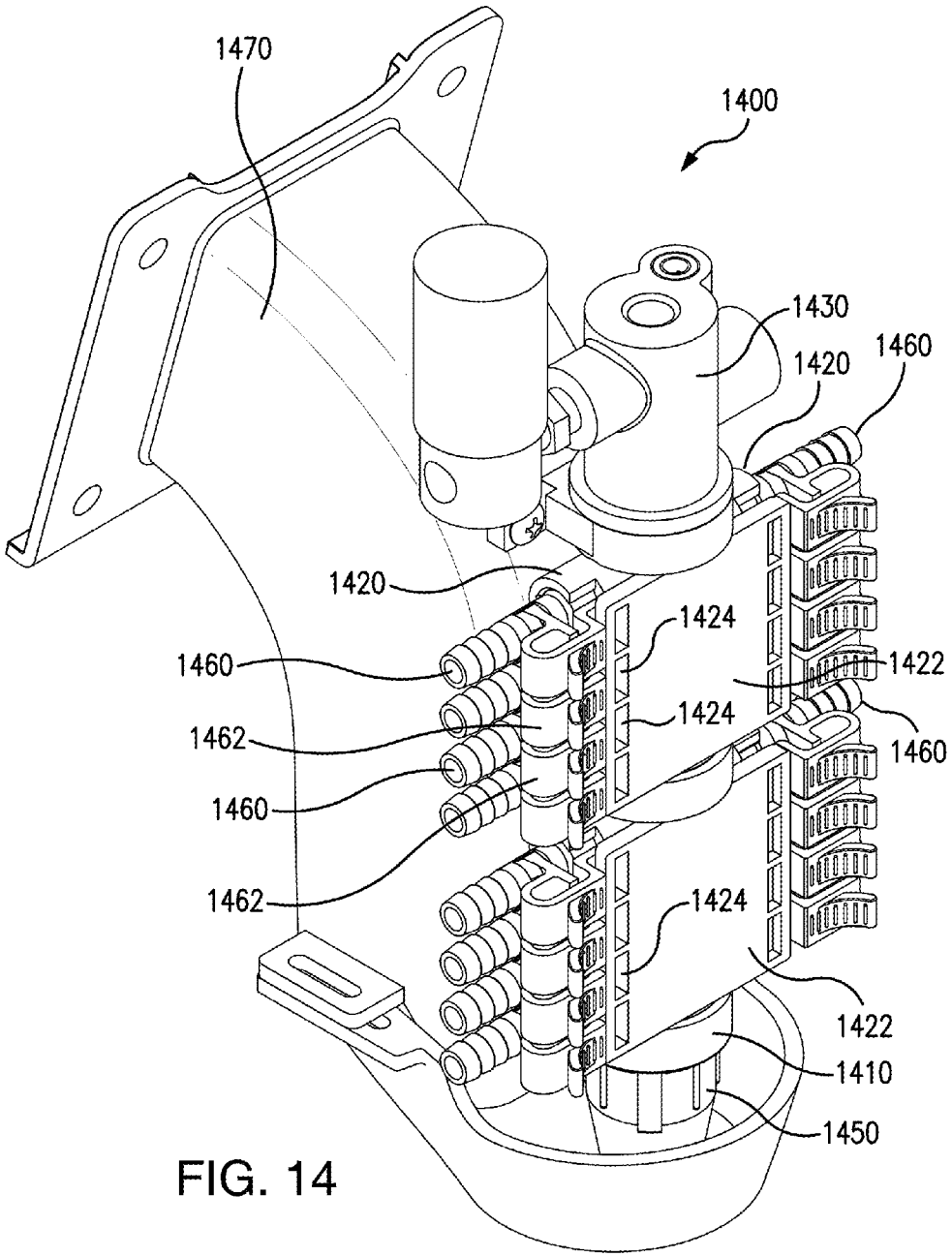
FIG. 14 is a perspective view of a beverage dispensing manifold according to an embodiment

FIG. 14 shows a vertical dispensing manifold 1400 for a dispenser according to an embodiment. Vertical dispensing manifold 1400 may include an input port 1430 for receiving a base liquid (e.g., a water). Input port 1430 may be the same as or similar to input port 230, 510, or 710. Input port 1430 may be coupled to a vertical shaft 1410 of dispensing manifold 1400 (e.g., via a releasable coupling, as discussed herein). A dispensing nozzle 1450 may be coupled to vertical shaft 1410 for dispensing a beverage from dispensing manifold 1400. In some embodiments, dispensing nozzle 1450 may be coupled to a lower end of vertical shaft 1410 (e.g., via a releasable coupling, as discussed herein). In some embodiments, dispensing manifold 1400 may include an ice chute 1470. Ice chute 1470 may be the same as or similar to ice chute 840 discussed herein.

Vertical shaft 1410 may be the same or similar to vertical shafts 210, 400 and 600 discussed herein. Vertical shaft 1410 may include a hollow interior (see e.g., 432 in FIG. 4) and a plurality of orifices 1420 for introducing one or more ingredients into the hollow interior. Each orifice 1420 may be in direct communication with the hollow interior of vertical shaft 1410. Each orifice 1420 may be configured to couple with (e.g., receive) an ingredient delivery fitting 1460. In some embodiments, ingredient delivery fittings 1460 may be releasably coupled to orifices 1420. Ingredient delivery fittings 1460 may be the same as or similar to ingredient delivery fittings 1000 and 1100 discussed herein.

In some embodiments, vertical shaft 1410 may include one or more stop walls 1422 configured to hold and/or position ingredient delivery fittings 1460 relative to orifices 1420 (e.g., within orifices 1420). In some embodiments, stop walls 1422 may be releasably coupled to vertical shaft 1410 (e.g., via mechanical fasteners such as screws). In some embodiments, stop walls 1422 may be non-releasably coupled to vertical shaft 1410 (e.g., via welding). In some embodiments, stop walls 1422 may be integrally formed with vertical shaft 1410, or a portion of vertical shaft 1410 (e.g., in embodiments including a modular vertical shaft 1410).

In some embodiments, stop walls 1422 may include a releasable fastener, such as a snap-fit fastener, for holding and/or positioning ingredient delivery fittings 1460 within orifices 1420. In such embodiments, the fasteners may engage a portion (e.g., a slot or detent) of an ingredient delivery fitting 1460 when an ingredient delivery fitting 1460 is properly positioned within an orifice 1420. In some embodiments, as shown for example in FIG. 14, ingredient delivery fittings 1460 may include a releasable fastener 1462, such as a snap-fit fastener, for holding and/or positioning ingredient delivery fittings 1460 within orifices 1420. In such embodiments, fasteners 1462 may engage slots 1424 formed in stop walls 1422. In some embodiments, slots 1424 may be through holes formed in stop walls 1422. In some embodiments, slots 1424 may be grooves/recesses formed in stop walls 1422.

Aspects of the dispensers, dispensing manifolds, dispensing systems and dispensing methods in FIGS. 1-14, or any part(s) or function(s) thereof, may be implemented using hardware, software modules, firmware, tangible computer readable media having instructions stored thereon, or a combination thereof and may be implemented in one or more computer systems or other processing systems.

Figure 15:
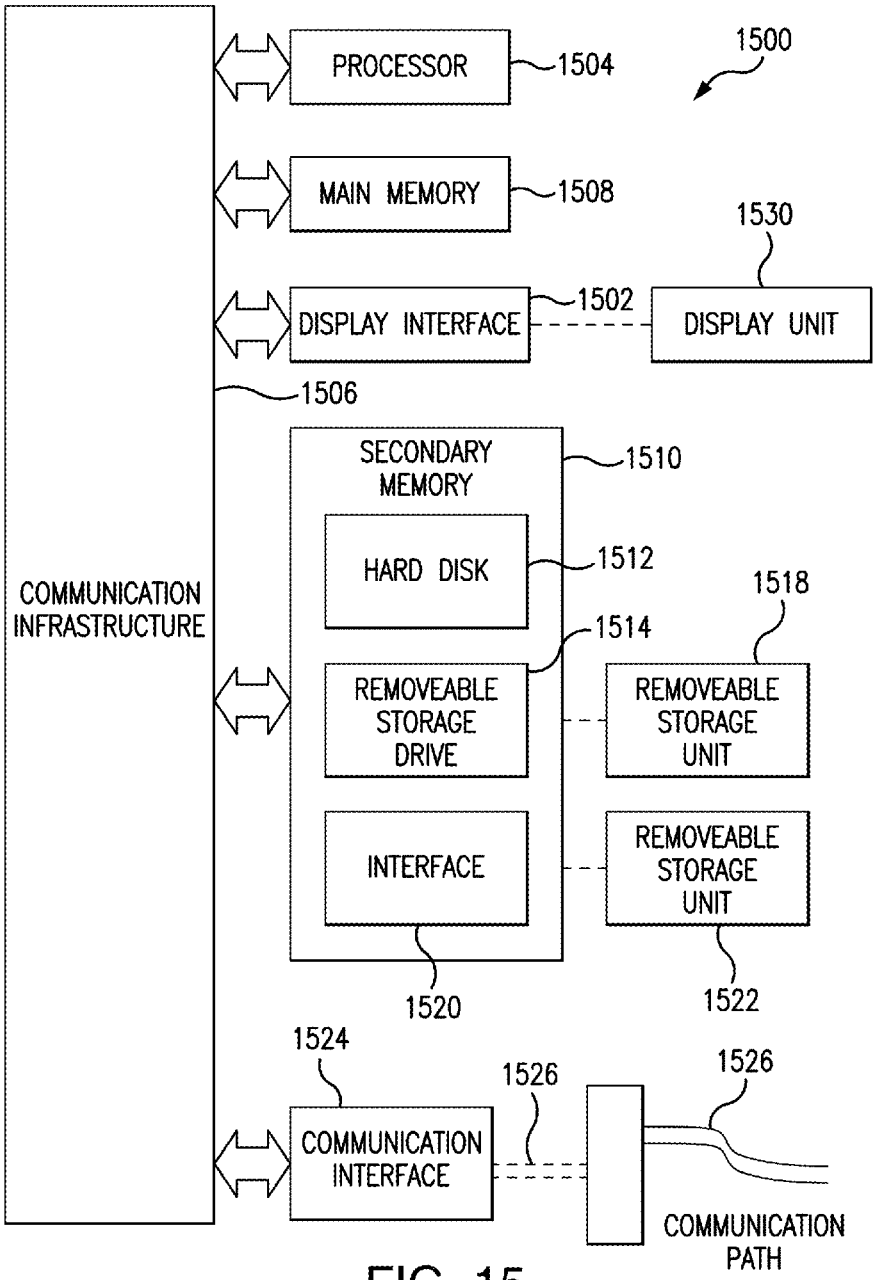
FIG. 15 is a schematic block diagram of an exemplary computer system in which embodiments may be implemented.

FIG. 15 illustrates an exemplary computer system 1500 in which embodiments, or portions thereof, may be implemented as computer-readable code. For example, portions of dispenser 1210 or dispensing system 1200, such as, controller 1220 or remote controller 1224 may be implemented in computer system 1500 using hardware, software, firmware, tangible computer readable media having instructions stored thereon, or a combination thereof and may be implemented in one or more computer systems or other processing systems.

If programmable logic is used, such logic may execute on a commercially available processing platform or a special purpose device. One of ordinary skill in the art may appreciate that embodiments of the disclosed subject matter can be practiced with various computer system configurations, including multi-core multiprocessor systems, minicomputers, and mainframe computers, computer linked or clustered with distributed functions, as well as pervasive or miniature computers that may be embedded into virtually any device.

For instance, at least one processor device and a memory may be used to implement the above described embodiments. A processor device may be a single processor, a plurality of processors, or combinations thereof. Processor devices may have one or more processor "cores."

Various embodiments of the invention(s) may be implemented in terms of this example computer system 1500. After reading this description, it will become apparent to a person skilled in the relevant art how to implement one or more of the invention(s) using other computer systems and/or computer architectures. Although operations may be described as a sequential process, some of the operations may in fact be performed in parallel, concurrently, and/or in a distributed environment, and with program code stored locally or remotely for access by single or multi-processor machines. In addition, in some embodiments the order of operations may be rearranged without departing from the spirit of the disclosed subject matter.

Processor device 1504 may be a special purpose or a general purpose processor device. As will be appreciated by persons skilled in the relevant art, processor device 1504 may also be a single processor in a multi-core/multiprocessor system, such system operating alone, or in a cluster of computing devices operating in a cluster or server farm. Processor device 1504 is connected to a communication infrastructure 1506, for example, a bus, message queue, network, or multi-core message-passing scheme.

Computer system 1500 also includes a main memory 1508, for example, random access memory (RAM), and may also include a secondary memory 1510. Secondary memory 1510 may include, for example, a hard disk drive 1512, or removable storage drive 1514. Removable storage drive 1514 may include a floppy disk drive, a magnetic tape drive, an optical disk drive, a flash memory, or the like. The removable storage drive 1514 reads from and/or writes to a removable storage unit 1518 in a well-known manner. Removable storage unit 1518 may include a floppy disk, magnetic tape, optical disk, a universal serial bus (USB) drive, etc. which is read by and written to by removable storage drive 1514. As will be appreciated by persons skilled in the relevant art, removable storage unit 1518 includes a computer usable storage medium having stored therein computer software and/or data.

Computer system 1500 (optionally) includes a display interface 1502 (which can include input and output devices such as keyboards, mice, etc.) that forwards graphics, text, and other data from communication infrastructure 1506 (or from a frame buffer not shown) for display on display unit 1530.

In alternative implementations, secondary memory 1510 may include other similar means for allowing computer programs or other instructions to be loaded into computer system 1500. Such means may include, for example, a removable storage unit 1522 and an interface 1520. Examples of such means may include a program cartridge and cartridge interface (such as that found in video game devices), a removable memory chip (such as an EPROM, or PROM) and associated socket, and other removable storage units 1522 and interfaces 1520 which allow software and data to be transferred from the removable storage unit 1522 to computer system 1500.

Computer system 1500 may also include a communication interface 1524. Communication interface 1524 allows software and data to be transferred between computer system 1500 and external devices. Communication interface 1524 may include a modem, a network interface (such as an Ethernet card), a communication port, a PCMCIA slot and card, or the like. Software and data transferred via communication interface 1524 may be in the form of signals, which may be electronic, electromagnetic, optical, or other signals capable of being received by communication interface 1524. These signals may be provided to communication interface 1524 via a communication path 1526. Communication path 1526 carries signals and may be implemented using wire or cable, fiber optics, a phone line, a cellular phone link, an RF link or other communication channels.

In this document, the terms "computer program medium" and "computer usable medium" are used to generally refer to media such as removable storage unit 1518, removable storage unit 1522, and a hard disk installed in hard disk drive 1512. Computer program medium and computer usable medium may also refer to memories, such as main memory 1508 and secondary memory 1510, which may be memory semiconductors (e.g. DRAMs, etc.).

Computer programs (also called computer control logic) are stored in main memory 1508 and/or secondary memory 1510. Computer programs may also be received via communication interface 1524. Such computer programs, when executed, enable computer system 1500 to implement the embodiments as discussed herein. In particular, the computer programs, when executed, enable processor device 1504 to implement the processes of the embodiments discussed here. Accordingly, such computer programs represent controllers of the computer system 1500. Where the embodiments are implemented using software, the software may be stored in a computer program product and loaded into computer system 1500 using removable storage drive 1514, interface 1520, and hard disk drive 1512, or communication interface 1524.

Embodiments of the invention(s) also may be directed to computer program products comprising software stored on any computer useable medium. Such software, when executed in one or more data processing device, causes a data processing device(s) to operate as described herein. Embodiments of the invention(s) may employ any computer useable or readable medium. Examples of computer useable mediums include, but are not limited to, primary storage devices (e.g., any type of random access memory), secondary storage devices (e.g., hard drives, floppy disks, CD ROMS, ZIP disks, tapes, magnetic storage devices, and optical storage devices, MEMS, nanotechnological storage device, etc.).

Some embodiments may include a vertical dispensing manifold for dispensing a beverage, the dispensing manifold including an input port for receiving a base liquid, a vertical shaft coupled to the input port, the vertical shaft including a hollow interior defined by a sidewall of the vertical shaft and a plurality of orifices for introducing ingredients into the hollow interior, where each orifice is formed in the sidewall of the vertical shaft and is in communication with the hollow interior of the vertical shaft, and a dispensing nozzle coupled to the vertical shaft for dispensing a combination of the base liquid and one or more ingredients, and where the hollow interior of the vertical shaft defines a vertical flow path for the flow of the base liquid from the input port, through the vertical shaft to combine with one or more ingredients, and to the dispensing nozzle.

In any of the various embodiments discussed herein, the vertical shaft may include a plurality of modules releasably coupled together between the input port and the dispensing nozzle, where each module includes one or more orifices for introducing ingredients into the hollow interior of the vertical shaft, and wherein each orifice is formed in a sidewall of the modules and is in communication with the hollow interior of the vertical shaft.

In any of the various embodiments discussed herein, each module of a vertical shaft may include a first coupling disposed on an upper end the module and a second coupling disposed on a lower end of the module.

In any of the various embodiments discussed herein, an uppermost module of a vertical shaft may be releasably coupled to an input port and a lowermost module of a vertical shaft may be releasably coupled to a dispensing nozzle.

In any of the various embodiments discussed herein, the vertical flow path may allow a base liquid to flow vertically between an input port and a dispensing nozzle, and the vertical flow may include uniform flow.

In any of the various embodiments discussed herein, the input port may include a diffuser.

In any of the various embodiment discussed herein, the orifices in a vertical shaft may be oriented in a direction substantially perpendicular to a central vertical axis of the vertical shaft. In any of the various embodiments discussed herein, a vertical shaft may include orifices located on opposing sides of the vertical shaft.

In any of the various embodiments discussed herein, the vertical shaft may be a single integrally formed piece. In any of the various embodiments discussed herein, the modules of a vertical shaft may be single integrally formed pieces. In an of the various embodiments discussed herein, the vertical shaft may be an injection molded piece. In any of the various embodiments discussed herein, the modules of a vertical shaft may be injection molded pieces.

In any of the various embodiments discussed herein, the orifices in a vertical shaft may be arranged vertically in a staggered configuration on the sidewall of the vertical shaft.

In any of the various embodiments discussed herein, an input port may be coupled to an upper end of a vertical shaft and a dispensing nozzle may be coupled to a lower end of the vertical shaft.

In any of the various embodiment discussed herein, the vertical manifold may include an ingredient delivery fitting coupled to an orifice and at least partially disposed in the orifice. In any of the various embodiments discussed herein, an ingredient delivery fitting may extend through an orifice to an interior surface of a vertical shaft. In any of the various embodiments discussed herein, an ingredient delivery fitting may not extend past the interior surface of a vertical shaft into the hollow interior of the vertical shaft.

In any of the various embodiments discussed herein, a vertical shaft may include an orifice having a first exterior diameter disposed vertically above an orifice having a second exterior diameter, where the first diameter is smaller than the second diameter. In any of the various embodiments discussed herein, a vertical shaft may include a plurality of orifices having a first exterior diameter and a plurality of orifices having a second exterior diameter larger than the first diameter, and all the orifices having the first diameter may be disposed above all the orifices having the second diameter.

In any of the various embodiments discussed herein, a vertical shaft may have a length measured between an input port and a dispensing nozzle, where the length of the vertical shaft is larger than the interior diameter of the vertical shaft.

Some embodiments may include a dispenser for dispensing a beverage, the dispenser including a vertical dispensing manifold having a vertical shaft with a hollow interior defined by a sidewall and a plurality of orifices formed in the sidewall for introducing ingredients into the hollow interior, an input port for receiving a base liquid coupled to an upper end of the vertical shaft, and a dispensing nozzle coupled to a lower end of the vertical shaft for dispensing a combination of the base liquid and one or more ingredients. The dispenser may also include a base liquid delivery tube in fluid communication with the input port and a plurality of ingredient tubes coupled to respective orifices by ingredient delivery fittings at least partially disposed within the orifices.

In any of the various embodiments discussed herein, the dispense may include an ice chute. In any of the various embodiments discussed herein, the ice chute may include a channel with a supply end coupled to an ice reservoir and a dispensing end surrounding at least a portion of a dispensing nozzle. In any of the various embodiments discussed herein, the dispensing end of an ice chute may include a funnel-shaped passage surrounding at least a portion of a dispensing nozzle.

In any of the various embodiments discussed herein, ingredient delivery fittings may be releasably disposed in the orifices in a vertical shaft. In any of the various embodiments discussed herein, one or more ingredient delivery fitting may include a valve to control the flow of an ingredient through the ingredient delivery fitting. In any of the various embodiments discussed herein, the valve of an ingredient delivery fitting may be an umbrella valve. In any of the various embodiments discussed herein, one or more ingredient delivery fitting may include a labyrinth flow path to control the flow of an ingredient through the ingredient delivery fitting.

In any of the various embodiments discussed herein, the dispenser may include a controller configured to control the delivery of a base liquid and one or more ingredients into a vertical shaft.

In any of the various embodiments discussed herein, the dispenser may include an ice chute having a channel with a dispensing end surrounding at least a portion of a dispensing nozzle and the controller may be configured to dispense ice from the ice chute and a base liquid mixed with one or more ingredients from the vertical shaft simultaneously.

Some embodiments may include a dispenser for dispensing a beverage, the dispenser including a dispensing manifold including an input port for receiving a base liquid, a mixing chamber coupled to the input port for mixing a base liquid with one or more ingredients, and a dispensing nozzle coupled to the mixing chamber for dispensing a combination of the base liquid and one or more ingredients. The dispenser may also include an ice reservoir and an ice chute including a channel with a supply end coupled to the ice reservoir and a dispensing end surrounding at least a portion of the dispensing nozzle.

In any of the various embodiments discussed herein, the dispenser may include an ice chute with a dispensing end that includes a funnel-shaped passage surrounding at least a portion of a dispensing nozzle.

Some embodiments may include a modular dispensing manifold for dispensing a beverage, the modular dispensing manifold including a first manifold module including a hollow interior defined by a sidewall of the first manifold module and a plurality of orifices formed in the sidewall of the first manifold module for introducing ingredients into the hollow interior, a first coupling disposed at an upper end of the first manifold module, and a second coupling disposed at a lower end of the first manifold module; a second manifold module including a hollow interior defined by a sidewall of the second manifold module and a plurality of orifices formed in the sidewall of the second manifold module for introducing ingredients into the hollow interior, a third coupling disposed at an upper end of the second manifold module, and a fourth coupling disposed at a lower end of the second manifold module; an input port coupled to the first coupling of the first manifold module, the input port configured to receive a base liquid; a dispensing nozzle coupled to the fourth coupling of the second manifold module, the dispensing nozzle configured to dispense a beverage, where the second coupling of the first manifold module is coupled to the third coupling of the second manifold module, and where the hollow interiors of the first and second manifold modules define a vertical flow path for the flow of the base liquid from the input port, through the vertical shaft, and to the dispensing nozzle.

In any of the various embodiments discussed herein, the second coupling of the first manifold module may be releasably coupled to the third coupling of the second manifold module.

In any of the various embodiments discussed herein, an input port may be releasably coupled to the first coupling of the first manifold module. In any of the various embodiments discussed herein, a dispensing nozzle may be releasably coupled to the fourth coupling of the second manifold module.

Some embodiments include a vertical dispensing manifold system including an input port configured to receive a base liquid, a vertical shaft configured to releasably couple to the input port, the vertical shaft including a hollow interior defined by a sidewall of the vertical shaft and a plurality of orifices formed in the sidewall of the vertical shaft for introducing ingredients into the hollow interior, and a dispensing nozzle configured to releasably couple to the vertical shaft for dispensing a combination of the base liquid and one or more ingredients.

In any of the various embodiments discussed herein, the vertical dispensing manifold system may include a plurality of ingredient delivery fittings configured to releasably couple to the orifices in a vertical shaft.

In any of the various embodiments discussed herein, the vertical dispensing manifold system may include an ice chute. In any of the various embodiments discussed herein, an ice chute may include a channel with an open first end and an open second end, and the open second end may have funnel shape configured to receive at least a portion of a dispensing nozzle.

In any of the various embodiments discussed herein, the vertical dispensing manifold system may include a plurality of modules configured to be releasably coupled together, each module including one or more orifices formed in a sidewall of the module for introducing ingredients into the hollow interior of the vertical shaft. In any of the various embodiments discussed herein, the plurality of modules of the vertical dispensing manifold system may be releasably coupled together.

Some embodiments include a method of dispensing a mixed beverage, the method including flowing a base liquid through a hollow interior of a dispensing manifold, the dispensing manifold including a vertical shaft having a hollow interior defined by a sidewall of the vertical shaft and a plurality of orifices for introducing ingredients into the hollow interior, where each orifice is formed in the sidewall of the vertical shaft and is in communication with the hollow interior of the vertical shaft; delivering one or more ingredients to the vertical shaft via the orifices formed in the sidewall of the vertical shaft while flowing the base liquid through the vertical shaft; and dispensing a mixed beverage including the base liquid and one or more ingredients at a dispense location while flowing the base liquid and the ingredients through the vertical shaft, where the flow of base liquid through the hollow interior of the dispensing manifold includes uniform flow.

In any of the various embodiments discussed herein, the method of dispensing a mixed beverage may include delivering ice at the dispense location of the mixed beverage. In any of the various embodiments discussed herein, the mixed beverage and the ice may be dispensed at the same time.

In any of the various embodiments discussed herein, the method of dispensing a mixed beverage may include flowing a rinsing dose of base liquid through a vertical shaft for a predetermined amount of time after delivering one or more ingredients to the vertical shaft and the predetermined amount of time may be 100 milliseconds or less. In any of the various embodiments discussed herein, the predetermined about of time may be less than 50 milliseconds.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventor(s), and thus, are not intended to limit the present invention(s) and the appended claims in any way.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. A vertical dispensing manifold for dispensing a beverage, the vertical dispensing manifold comprising:

an input port for receiving a base liquid;

a vertical shaft coupled to the input port, the vertical shaft comprising a hollow interior defined by an interior surface of a sidewall of the vertical shaft and a plurality of orifices for introducing ingredients into the hollow interior, where each orifice is formed in the sidewall of the vertical shaft and defines an opening on the interior surface of the sidewall that is in communication with the hollow interior of the vertical shaft; and a dispensing nozzle coupled to the vertical shaft for dispensing a combination of the base liquid and one or more ingredients;

wherein the hollow interior of the vertical shaft defines a vertical flow path for the flow of the base liquid from the input port, through the vertical shaft to combine with one or more ingredients, and to the dispensing nozzle, and wherein at least two of the openings on the interior surface of the sidewall are arranged vertically in a staggered configured on the interior surface.

2. The vertical dispensing manifold of claim 1, wherein the vertical shaft comprises a plurality of modules releasably coupled together between the input port and the dispensing nozzle, wherein each module comprises one or more orifices for introducing ingredients into the hollow interior of the vertical shaft, and wherein each orifice is formed in a sidewall of the modules and is in communication with the hollow interior of the vertical shaft.

3. The vertical dispensing manifold of claim 2, wherein each module comprises a first coupling disposed on an upper end the module and a second coupling disposed on a lower end of the module.

4. The vertical dispensing manifold of claim 2, wherein an uppermost module is releasably coupled to the input port and a lowermost module is releasably coupled to the dispensing nozzle.

5. The vertical dispensing manifold of claim 2, wherein the modules are single integrally formed pieces.

6. The vertical dispensing manifold of claim 1, wherein the vertical flow path allows the base liquid to flow vertically between the input port and the dispensing nozzle, and wherein the vertical flow comprises uniform flow.

7. The vertical dispensing manifold of claim 1, wherein the orifices in the vertical shaft are oriented in a direction substantially perpendicular to a central vertical axis of the vertical shaft.

8. The vertical dispensing manifold of claim 1, wherein the vertical shaft comprises orifices located on opposing sides of the vertical shaft.

9. The vertical dispensing manifold of claim 1, wherein the vertical shaft is a single integrally formed piece.

10. The vertical dispensing manifold of claim 1, wherein the input port is coupled to an upper end of the vertical shaft and the dispensing nozzle is coupled to a lower end of the vertical shaft.

11. The vertical dispensing manifold of claim 1, further comprising an ingredient delivery fitting coupled to an orifice and at least partially disposed in the orifice.

12. The vertical dispensing manifold of claim 1, wherein the vertical shaft comprises an orifice having a first exterior diameter disposed vertically above an orifice having a second exterior diameter, and wherein the first exterior diameter is smaller than the second exterior diameter.

13. The vertical dispensing manifold of claim 1, wherein the vertical shaft comprises a plurality of orifices having a first exterior diameter and a plurality of orifices having a second exterior diameter larger than the first exterior diameter, and wherein all the orifices having the first exterior diameter are disposed above all the orifices having the second exterior diameter.

14. The vertical dispensing manifold of claim 1, wherein the vertical shaft comprises a length measured between the input port and the dispensing nozzle, and wherein the length of the vertical shaft is larger than the interior diameter of the vertical shaft.

15. A dispenser for dispensing a beverage, the dispenser comprising:

a vertical dispensing manifold comprising:

a vertical shaft comprising a hollow interior defined by a sidewall and a plurality of orifices formed in the sidewall for introducing ingredients into the hollow interior, the orifices arranged vertically in a staggered configuration, an input port for receiving a base liquid coupled to an upper end of the vertical shaft, and a dispensing nozzle coupled to a lower end of the vertical shaft for dispensing a combination of the base liquid and one or more ingredients;

a base liquid delivery tube in fluid communication with the input port; and a plurality of ingredient tubes coupled to respective orifices by ingredient delivery fittings at least partially disposed within the orifices.

16. The dispenser of claim 15, further comprising an ice chute.

17. The dispenser of claim 16, wherein the ice chute comprises a channel with a supply end coupled to an ice reservoir and a dispensing end surrounding at least a portion of the dispensing nozzle.

18. The dispenser of claim 15, wherein the ingredient delivery fittings are releasably disposed in the orifices in the vertical shaft.

19. A modular dispensing manifold for dispensing a beverage, the modular dispensing manifold comprising:

a first manifold module comprising a hollow interior defined by a sidewall of the first manifold module and a plurality of orifices formed in the sidewall of the first manifold module for introducing ingredients into the hollow interior, a first coupling disposed at an upper end of the first manifold module, and a second coupling disposed at a lower end of the first manifold module;

a second manifold module comprising a hollow interior defined by a sidewall of the second manifold module and a plurality of orifices formed in the sidewall of the second manifold module for introducing ingredients into the hollow interior, a third coupling disposed at an upper end of the second manifold module, and a fourth coupling disposed at a lower end of the second manifold module;

an input port coupled to the first coupling of the first manifold module, the input port configured to receive a base liquid;

a dispensing nozzle coupled to the fourth coupling of the second manifold module, the dispensing nozzle configured to dispense a beverage;

wherein the second coupling of the first manifold module is releasably coupled to the third coupling of the second manifold module, and wherein the hollow interiors of the first and second manifold modules define a vertical flow path for the flow of the base liquid from the input port, through the vertical shaft, and to the dispensing nozzle.

20. A dispenser for dispensing a beverage, the dispenser comprising:

a vertical dispensing manifold comprising:

a vertical shaft comprising a hollow interior defined by a sidewall and a plurality of orifices formed in the sidewall for introducing ingredients into the hollow interior, an input port for receiving a base liquid coupled to an upper end of the vertical shaft, and a dispensing nozzle coupled to a lower end of the vertical shaft for dispensing a combination of the base liquid and one or more ingredients;

a base liquid delivery tube in fluid communication with the input port;

a plurality of ingredient tubes coupled to respective orifices by ingredient delivery fittings at least partially disposed within the orifices; and an ice chute comprising a channel with a supply end coupled to an ice reservoir and a dispensing end surrounding at least a portion of the dispensing nozzle.

* * * * *